US006271763B1

(12) United States Patent
Hur

(10) Patent No.: US 6,271,763 B1
(45) **Date of Patent: *Aug. 7, 2001**

(54) AUDIBLE AND AUDIBLE-VISIBLE ALARMS WITH INTERCHANGEABLE COVER

(75) Inventor: Inhong Hur, Oakhurst, NJ (US)

(73) Assignee: Wheelock, Inc., Long Beach, NJ (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/337,901

(22) Filed: Jun. 21, 1999

Related U.S. Application Data

(63) Continuation of application No. 09/045,105, filed on Mar. 20, 1998, now Pat. No. 5,969,627, which is a continuation-in-part of application No. 08/876,615, filed on Jun. 16, 1997, now Pat. No. 5,805,071, which is a division of application No. 08/524,865, filed on Sep. 7, 1995, now Pat. No. 5,684,467.

(51) Int. Cl.[7] ..... G08B 23/00

(52) U.S. Cl. ..... 340/693.12; 340/693.5; 340/693.9; 340/693.3; 340/692; 340/691.7; 340/815.73; 340/815.74; 340/384.1; 340/391.1; 340/396.1

(58) Field of Search ..... 340/693.12, 693.5, 340/693.9, 693.3, 692, 691.7, 815.73, 815.74, 384.1, 391.1, 396.1

(56) References Cited

U.S. PATENT DOCUMENTS

| | | | | |
|---|---|---|---|---|
| 3,475,744 | * | 10/1969 | Frankfurt | 340/515 |
| 3,787,014 | | 1/1974 | Story et al. | 248/558 |
| 4,164,076 | | 8/1979 | Carrigan | 33/644 |
| 4,424,553 | * | 1/1984 | Marsocci et al. | 361/825 |
| 4,763,112 | | 8/1988 | Hsieh | 340/573.1 |
| 4,841,288 | * | 6/1989 | Addicks | 340/690 |

(List continued on next page.)

OTHER PUBLICATIONS

Wheelock brochure (P82467–001F), Installation Instructions Multitone Signals MT–12/24, MT 4–12/24 (1993, 1994); pp 1–4.

Wheelock brochure, "Fire Alarm Systems, Series AMT and AMT Strobe Multitone Electronic Appliances" (1997).

Wheelock brochure, "Fire Alarm Systems, Series NS/NS4 Horn Strobe Appliances—Series NH Horn Appliance" (1997).

Wheelock brochure, "Fire Alarm Systems, Series RS Strobes and Series RSS Non–Sync/Sync Strobes" (1998).

Wheelock brochure, Series MT and MT Strobe Multitone Electronic Signals; p. 8.

Wheelock Inc brochure, "Fire Alarm Systems, Series NS/NS4 Horn Strobe Appliances—Series NH Horn Appliances" 1997.

Installation Instructions–Owner's Information, Gentex Corporation GXS Series "Remote Visual Signaling Appliance" (UL 1971 compliant).

Wheelock Drawing No. P80178–001, Dated Sep. 11, 1985 "Adaptor Bracket".

Simplex Brochure, Multi–Application Peripherals and Accessories, pp. 1–4, Jul. 1994.

*Primary Examiner*—Benjamin C. Lee
(74) *Attorney, Agent, or Firm*—Thomason, Moser & Patterson, LLP; Kin-Wah Tong

(57) ABSTRACT

The bases of an audible alarm unit and an audible/visible alarm unit are configured to be used interchangeably with a single cover. The cover has an opening that receives a projecting wall portion on the base of the audible alarm unit and a receptacle for a strobe lamp unit on the base of the audible/visible alarm unit. The bases have mounting holes that enable the alarm units to be mounted on several types of standard backboxes, the cover concealing the screw holes for good appearance of the installed units.

49 Claims, 15 Drawing Sheets

U.S. PATENT DOCUMENTS

| | | | | |
|---|---|---|---|---|
| 4,929,093 | | 5/1990 | Suzuki et al. | 374/208 |
| 5,096,405 | | 3/1992 | Pace et al. | 425/192 R |
| 5,135,411 | | 8/1992 | Wiley et al. | 439/535 |
| 5,153,567 | | 10/1992 | Chimento | 340/691.5 |
| 5,272,605 | * | 12/1993 | Johnstone | 362/147 |
| 5,280,273 | | 1/1994 | Goldstein | 340/632 |
| 5,434,561 | | 7/1995 | Greening et al. | 340/603 |
| 5,486,816 | | 1/1996 | Ariga et al. | 340/630 |
| 5,621,387 | * | 4/1997 | Phillips et al. | 340/545.6 |
| 5,684,467 | * | 11/1997 | Hur | 340/693.9 |
| 5,710,541 | | 1/1998 | Stanley et al. | 340/628 |
| 5,767,782 | * | 6/1998 | Mongeau | 340/693.12 |
| 5,805,071 | * | 9/1998 | Hur | 340/693.9 |
| 5,969,627 | * | 10/1999 | Tarlton et al. | 340/693.12 |

* cited by examiner

AUDIBLE AND AUDIBLE-VISIBLE ALARMS WITH INTERCHANGEABLE COVER

This application is a continuation of U.S. patent application Ser. No. 09/045,105 filed Mar. 20, 1998, now U.S. Pat. No. 5,969,627 which is a continuation-in-part of U.S. patent application Ser. No. 08/876,615, filed Jun. 16, 1997, now U.S. Pat. No. 5,805,071 which is a division of U.S. patent application Ser. No. 08/524,865, filed Sep. 7, 1995, now U.S. Pat. No. 5,684,467.

BACKGROUND OF THE INVENTION

Audible and audible-visible alarms are widely used, especially in commercial, office and institutional buildings, as elements of fire safety installations. Both audible and audible-visible alarms have a sound generator, such as a horn, bell or siren, and associated electronic circuitry for driving the sound generator. Audible-visible alarms have, in addition to the sound generator and its driving circuitry, a light source, which is universally a strobe lamp, and electronic circuitry for firing the lamp. It is well known, per se, to provide the sound generator and driving circuitry in the form of a circuit board module, which has input terminal connectors for connecting the module to signal wires that originate at a remote control unit. The control unit receives input signals from heat and smoke detectors and sets off alarms in selected zones that may become hazardous to building occupants as a result of a fire indicated by inputs from particular detectors. Similarly, strobe lamp firing circuits and the strobe light are commonly produced as circuit board electronic modules and strobe light units, the latter consisting of a mounting board and a light reflector and a strobe lamp or lamps mounted directly to the board.

Audible and audible-visible alarms are almost always mounted on walls using electrical backbones. Many previously known alarms have had mounting plates that serve as both mountings for the alarm modules and covers that conceal the modules. Because there are several sizes and configurations of backboxes in common use, the mounting plates have been produced in different sizes and configurations for use with the different styles of backboxes. Recently, the owner of the present invention has introduced alarms with universal mounting plates that have multiple sets of screw holes, each set being used with a different backbox style. The multiple screw holes make it desirable to have a cover, separate from the mounting plate on which the alarm module is mounted, to conceal the screw holes. The covers for the universal mounting plates snap on to the mounting plate and thus not only conceal the multiple screw holes and the screws but have no visible screws, which improves the appearance of the alarm as compared to mounting plates that also serve as covers and in which the screws are visible. The universal mounting plates and covers referred to above are described and shown in U.S patent application Ser. No. 08/524,865, filed Sep. 7, 1995, now U.S. Pat. No. 5,684,467 which application is incorporated into the present specification for all purposes.

The strobe light units of audible-visible alarms must protrude from the front of a mounting plate or cover so that the light can propagate not only away from the wall but in 10 directions parallel to the wall. Accordingly, the covers for the universal mounting plates have a hole, through which the strobe light unit can protrude from the mounting plate. Audible alarms have no protruding element, so a cover without a hole is provided. The need for different covers for audible and audible-visible alarms increases costs in the form of design and tooling expenses and inventory stocking and control. The possibility of mistakes in ordering and delivery can produce delays in installation. If an installer does not match the units and the covers at the job site, he or she will have to exchange the non-matching covers before the job can be completed. Meanwhile, the distributor who supplied the installer will probably have a mismatch in the stocks of units and covers. In a large job, the installer will have to allocate matching units and covers for each alarm site. Mismatches will result in lost time when the installer has to go to a storage location and correct a mismatch.

SUMMARY OF THE INVENTION

An object of the present invention is to reduce the costs, possible mistakes and delays, and the inconveniences of making, stocking and selecting matched alarm units and covers. Another object is to provide audible and audible-visible alarms that are durable, easy to install and attractive in appearance.

The foregoing objects are attained, in accordance with the present invention, by an alarm assembly comprising an alarm unit selected from an audible alarm unit and an audible-visible alarm unit, and a decorative cover adapted for use interchangeably with the audible alarm unit and the audible-visible alarm unit and detachably connected to the selected alarm unit. The cover has a front wall, which has an opening for a strobe light unit, and side walls extending generally rearwardly from the front wall and defining a rear cavity containing the selected alarm unit.

The audible alarm unit with which the cover is used has a base member that is adapted to support a sound generating unit, i.e., a circuit board module having a sound generator and electronic circuitry for driving the sound generator. Sets of screw holes in selected positions in the base member provide for attaching the base member to electrical backboxes of different styles. A projecting wall portion on the base plate is receivable with a close peripheral clearance in the opening in the front wall of the cover, the projecting wall portion having a front surface contoured and configured to match contours and configurations of adjacent portions of the front surface of the front wall of the cover such that the front surface of the cover and the front surface of the projecting wall portion of the base of the audible alarm unit are visually unitary. More simply put, the projecting wall portion of the base member fills the opening in the cover in a manner that makes it look like the cover does not have an opening.

The audible-visible alarm unit with which the cover is used has a base member that is adapted to support a sound generating unit and a light generating unit that includes a strobe lamp unit having a mounting plate, a strobe lamp and a transparent strobe lamp cover. The base has screw holes in selected positions adapted to receive screws by which the audible-visible alarm unit is adapted to be attached to electrical backbones of different styles and a receptacle that is adapted to receive the strobe lamp unit. The receptacle is defined by peripheral walls that are receivable with a close peripheral clearance in the opening in the cover and project out from the front surface of the cover so as to enable light from the strobe lamp unit installed in the receptacle to be emitted laterally (parallel to a wall) and frontally (out from the wall) with respect to the front surface of the cover.

The interchangeable cover eliminates the need to design, tool up for, produce, catalog, stock, allocate and ship one cover for audible alarm units and another for audible-visible alarm units. The chances for mistakes and delays due to mismatches between covers and alarm units at the manufacturing, distributing and installing levels are eliminated. Inventory maintenance and control are simplified. At the job site, the installer does not have to select different covers for different alarms. After some or all of the alarms for the job are installed, the installer can take boxes of the covers around to the alarms and install any one of them on either of the alarm types. In some cases, however, installers may have to select and install covers that are of colors that match the colors of the alarm units.

The base member of either or both the audible alarm unit and the audible-visible alarm unit may have a front wall, from which the projecting wall portion projects as a raised protuberance, and side walls extending generally rearwardly from the front wall, the front wall and side walls forming a cavity that is adapted to receive the sound generating unit and, in the case of the audible-visible alarm unit, the light-generating unit in recessed relation with respect to rear edges of the side walls. Such a configuration locates the circuit boards, electronic components, and sound generator on the side of the base member that faces away from the cover and toward the backbox, so the base member provides protection for the modules when the cover is not installed and increases the resistance of the assembly (cover in place) to damage of the modules, should the assembly suffer an impact—the cover and part of the base member together provide a double-walled casing for the modules. Advantageously, the shapes of the perimeters of the base members of the alarm units generally match the shape of the perimeter of the cover such that the base members nest in the covers of the assemblies.

The front wall of the cover and the front wall of the base member of the audible alarm unit may have registering sound openings to facilitate transmission of sound from the sound generating unit. The sound openings may be masked visually by a grillework on the front wall of the cover, such as parallel straight grille bars extending across the sound opening. Additional parallel straight ribs adjacent the grille bars and forming a faux grille, at least some of which are aligned with and contiguous to the grille bars enhance the visual masking of the sound opening.

In order to somewhat conceal the fact that the projecting wall portion on the base member of the audible alarm is separate from the cover, it is desirable to provide projecting ribs that form a faux grille on the outer face of the projecting portion. The faux grille attracts an observer's attention as a decorative theme, thus drawing attention away from the narrow gap between the border of the opening in the cover and the edges of the projecting portion. The faux grille also graphically communicates to an observer the fact that the alarm includes a sound generator. The grille/faux grille theme is a graphic indication to an observer of a sound function of the device—a "cone-of-sound" graphic.

In preferred embodiments of the present invention, the cover is substantially rectangular, and preferably square, in front elevation, the front wall of the cover includes a substantially planar and rectangular portion and beveled side portions along margins of the planar portion, and the side walls of the cover are oriented substantially orthogonally with respect to the planar portion. The opening in the front wall of the cover is elongated and substantially rectangular in front elevation, extends entirely across the planar portion and partway along opposite beveled side portions, and is oriented with its edges parallel to the side walls of the cover. The opening in the front wall of the cover is offset with respect to a centerline of the cover parallel to a longer axis of the opening. The rectangular, preferably square, shape corresponds to that of large, square backboxes, thus adapting the alarm for universal use. The bevels on the front wall of the cover reduce the visual mass of the alarm.

For a better understanding of the invention, reference may be made to the following description of an exemplary embodiment, taken in conjunction with the accompanying drawings.

DESCRIPTION OF THE EMBODIMENT

Figure 1:
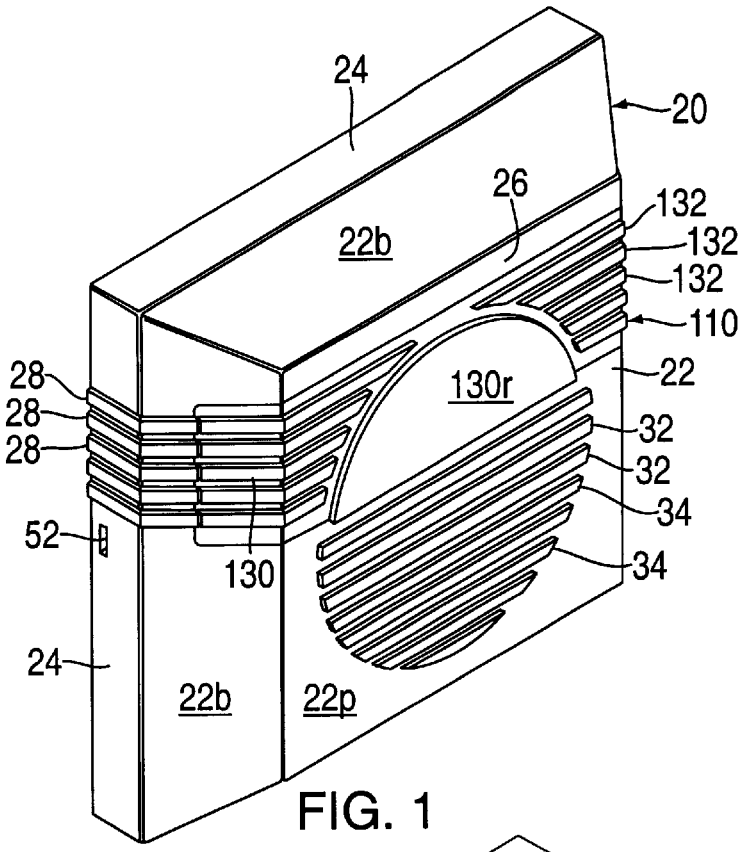
FIG. 1 is a ¾ front pictorial view of the audible alarm.
Figure 2:
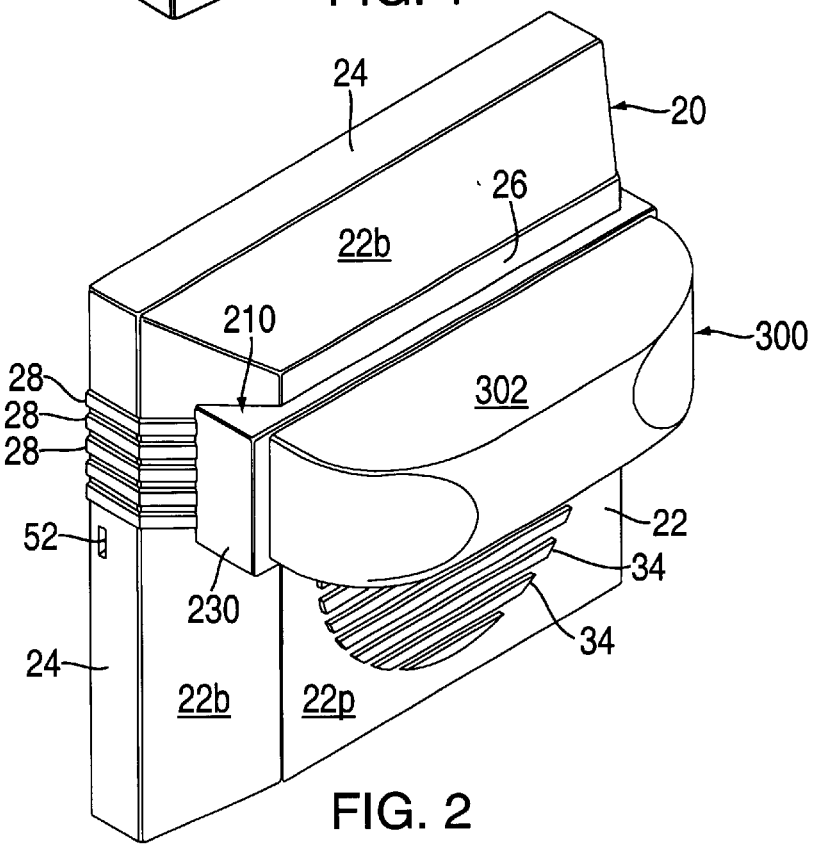
FIG. 2 is a ¾ front pictorial view of the audible-visible alarm.
Figure 4:
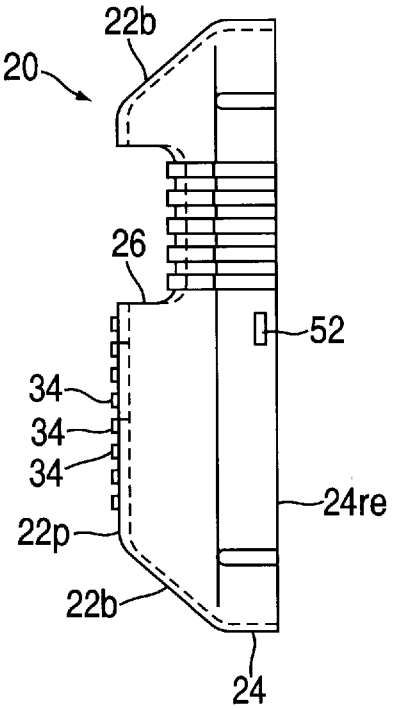
FIG. 4 is a side elevational view of the cover.
Figure 5:
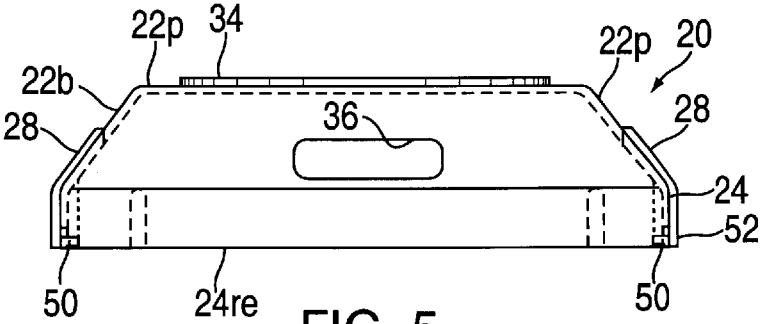
FIG. 5 is a bottom view of the cover.
Figure 3:
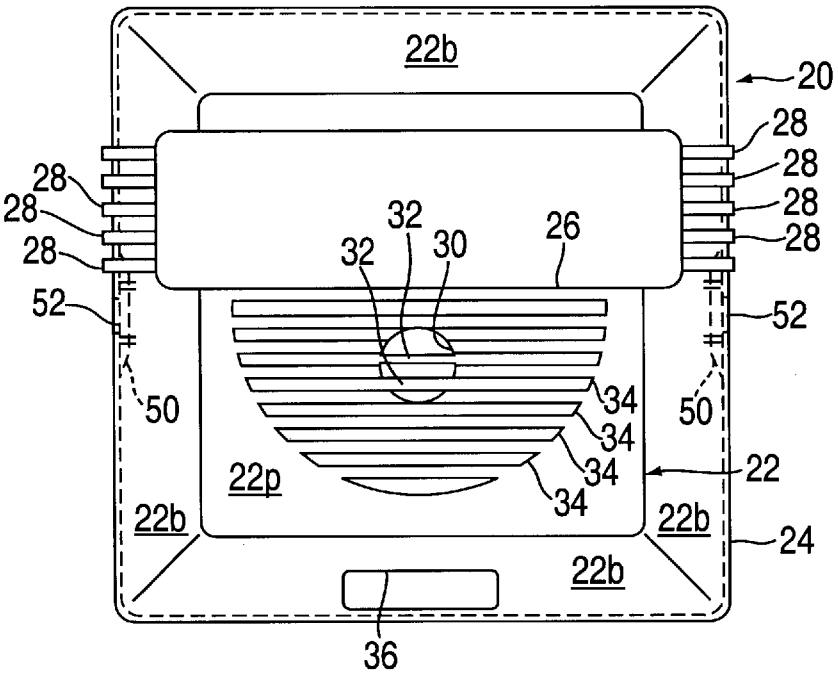
FIG. 3 is a front elevational view of the cover used for both of the alarms of FIGS. 1 and 2.
Figure 7:
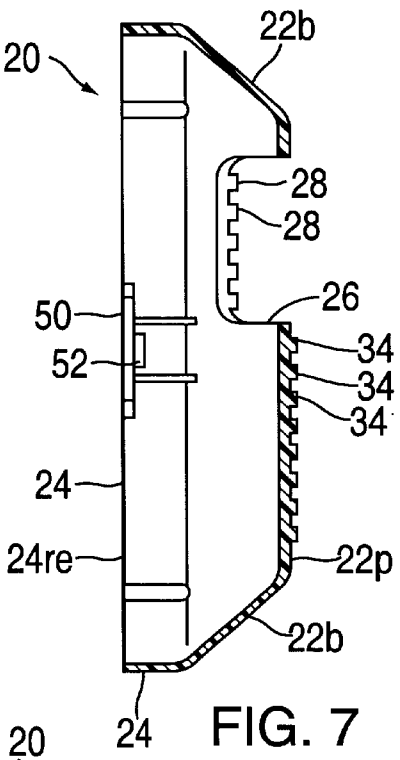
FIG. 7 is a side cross-sectional view of the cover, taken along the lines 7—7 of FIG. 6.
Figure 8:
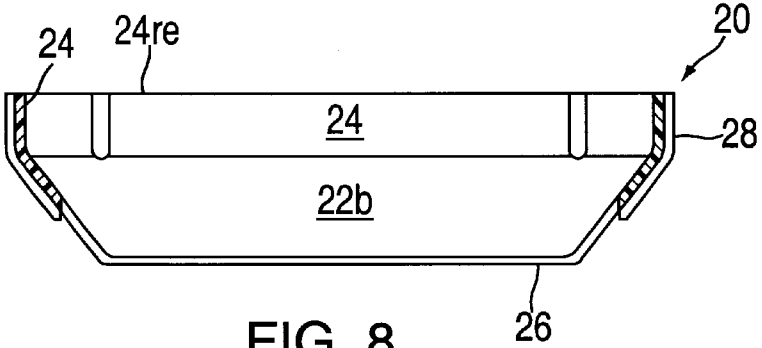
FIG. 8 is a top cross-sectional view of the cover, taken along the lines 8—8 of FIG. 6.
Figure 6:
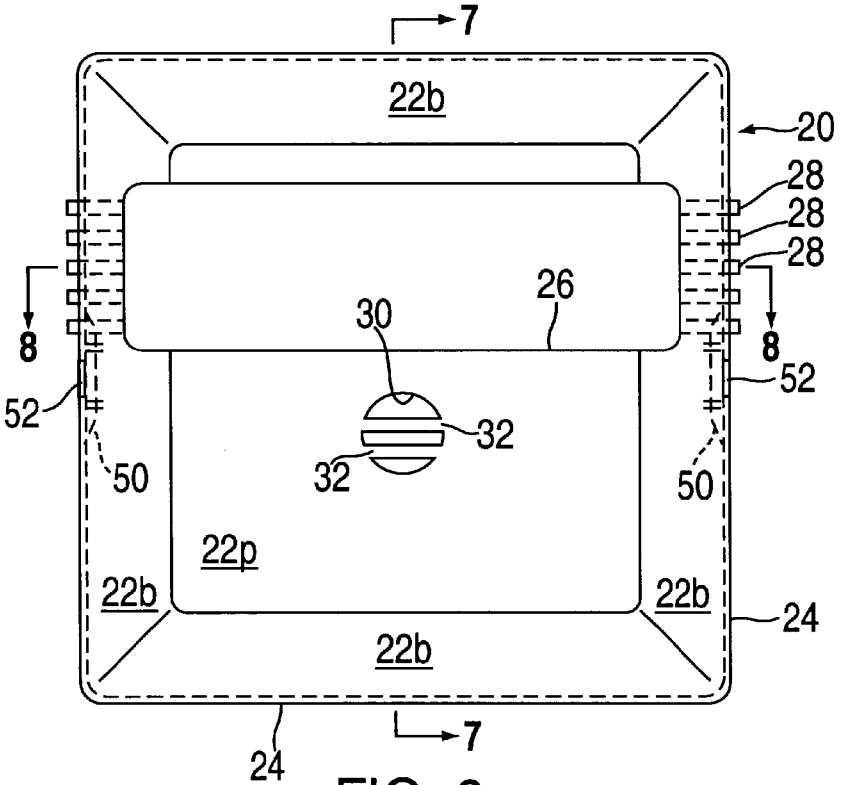
FIG. 6 is a rear elevational view of the cover.
Figure 10:
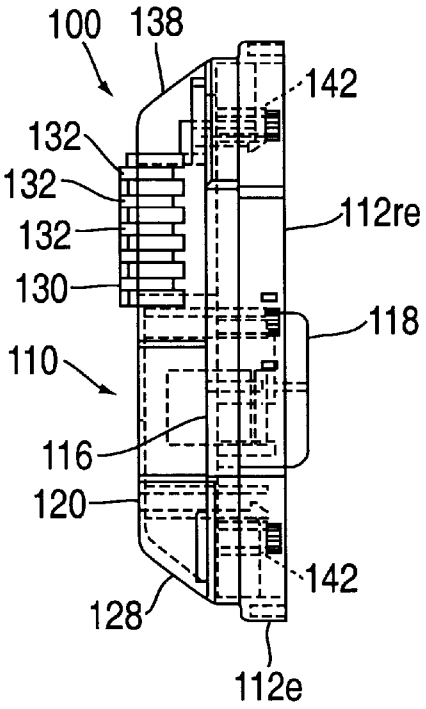
FIG. 10. is a side elevational view of the base member of FIG. 9.
Figure 11:
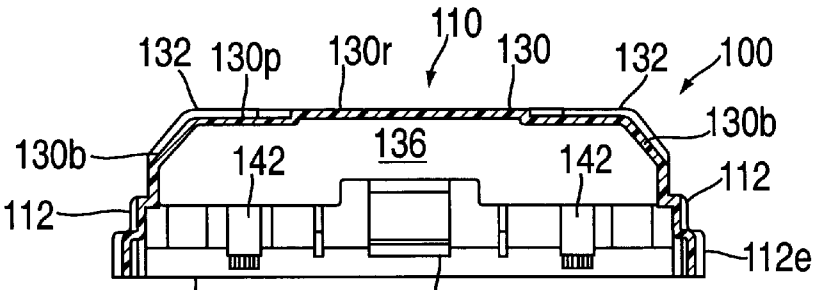
FIG. 11 is a bottom cross-sectional view of the base member of FIG. 9, taken along the lines 11—11 of FIG. 9.
Figure 9:
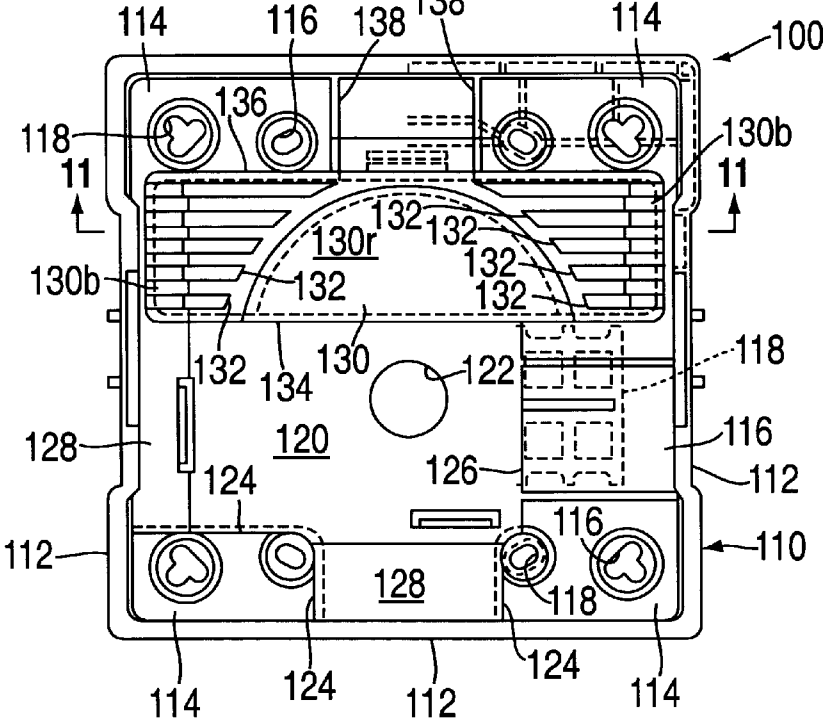
FIG. 9 is a front elevational view of the base member of the audible alarm of FIG. 1.
Figure 13:
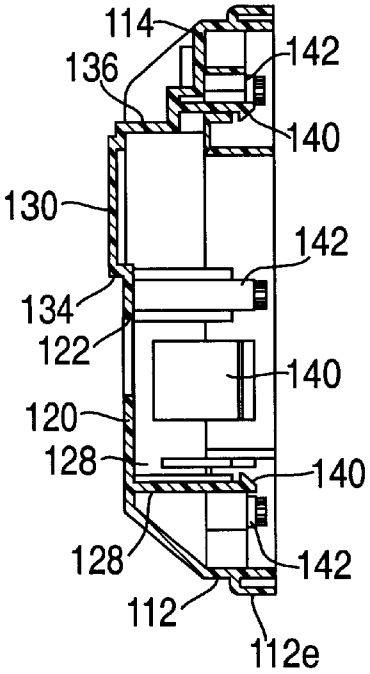
FIG. 13 is a side cross-sectional view of the cover, taken along the lines 13—13 of FIG. 12.
Figure 14:
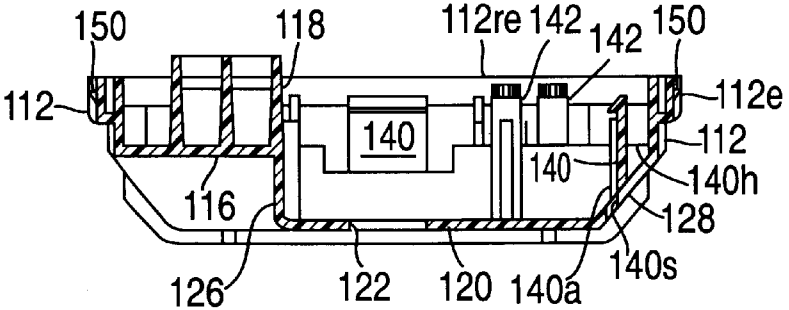
FIG. 14 is a bottom cross-sectional view of the base member of FIG. 9, taken along the lines 14—14 of FIG. 12.
Figure 12:
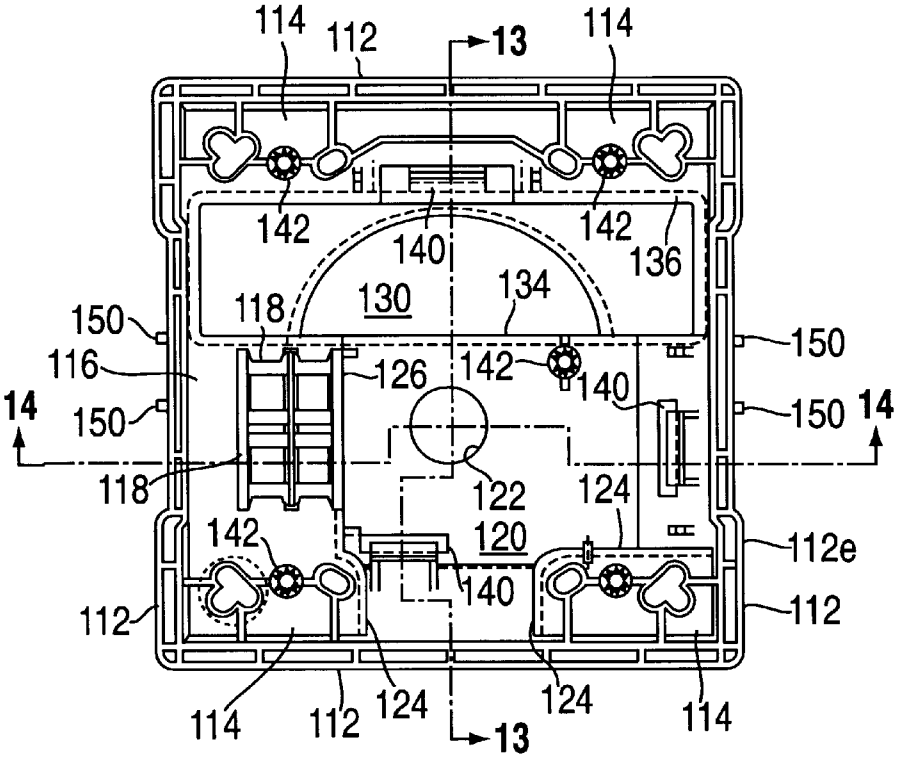
FIG. 12 is a rear elevational view of the base member of FIG. 9.
Figure 16:
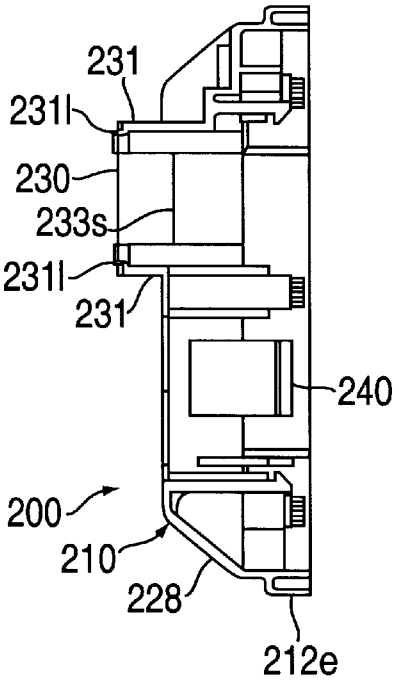
FIG. 16 is a side cross-sectional view of the base member of FIG. 15, taken generally along the lines 16—16 of FIG. 15.
Figure 17:
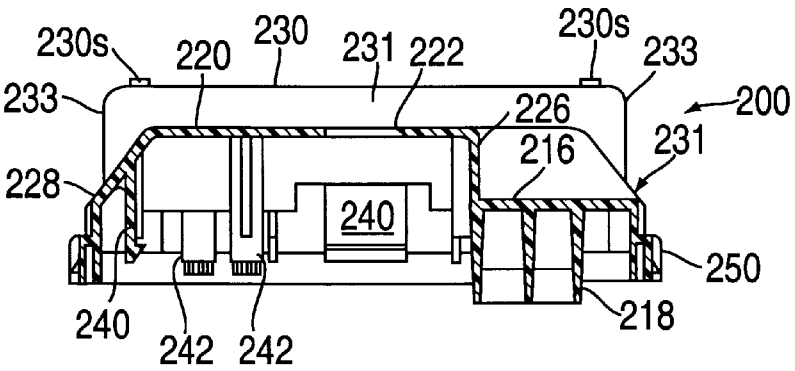
FIG. 17 is a bottom cross-sectional view of the base member of FIG. 15, take generally along the lines 17—17 of FIG. 15.
Figure 15:
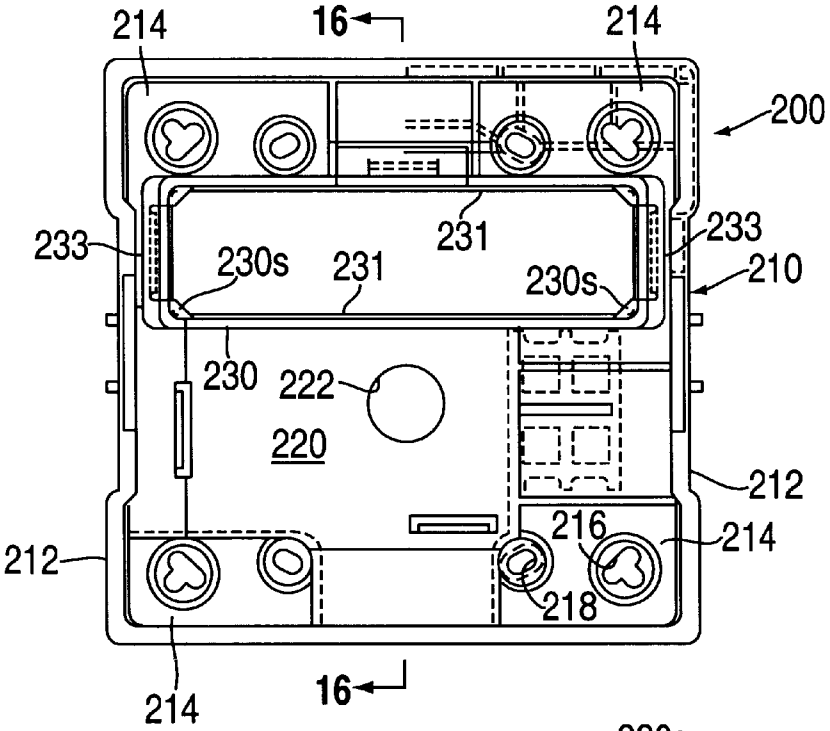
FIG. 15 is a front elevational view of the base member of the audible-visible alarm of FIG. 2.
Figure 18:
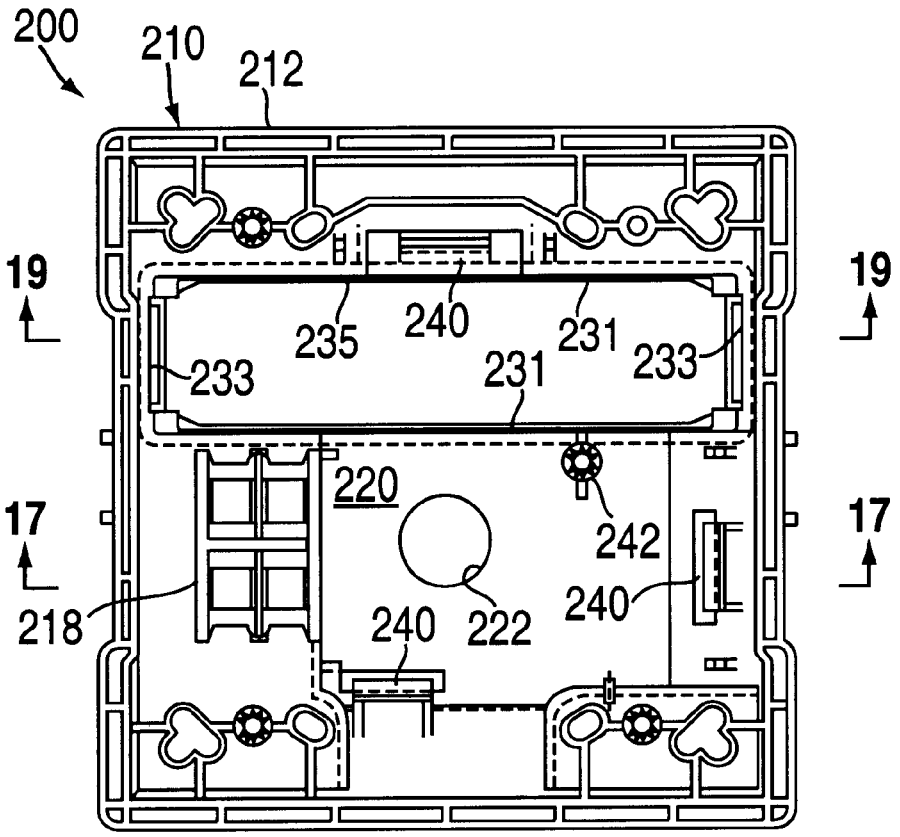
FIG. 18 is a rear elevational view of the base member of FIG. 15.

Both the audible alarm of FIG. 1 and the audible-visible alarm of FIG. 2 have the same cover 20, which is square in plan, has a front wall 22 having a square, generally planar portion 22*p* and beveled portions 22*b* along each edge of the planar portion. The beveled portions 22*b*, which slope at 50° with respect to the planar portion 22*p*, provide a large volume cavity and a low visual mass for the alarm. Side walls 24 extend rearwardly from and along the perimeter of the front wall 22 and terminate along rear edges 24*re* that lie in a plane for engagement with a wall surface adjacent a backbox (not shown) over which the alarm is installed. The front wall 22 has an opening 26, which is rectangular in plan and extends horizontally across the planar portion 22*p* and partway along each beveled portion 22*b*. The opening 26 is flanked by parallel ribs 28, which form a faux grille. A hole 30 in the front wall registers with a sound generator (not shown) and allows the sound to propagate more readily into the space in which the alarm is installed.

Grille bars 32 extend across the hole to mask it visually and prevent tampering with the sound generator, as required by UL for certification. Ribs 34 on the front wall, two of which are coextensive with the grille bars 32, form a semi-circular faux grille, which enhances the visual masking of the hole 30 by drawing a viewer's eye to a prominent decorative element. The ribs 34 also impart stiffness to the front wall of the cover. The shape of the faux grille may, of course, vary, and the faux grille can also be omitted, although some form of faux grille or real grille is desirable for esthetic reasons, including the graphic communication function referred to above. The rectangular feature 36 is a shallow depression for a self-adhesive label.

The cover is used interchangeably with an audible alarm unit 100 (FIGS. 9 to 14) and an audible/visible alarm unit 200 (FIGS. 15 to 19). The drawings show only the bases 110 and 210 of the alarm units 100 and 200, inasmuch as suitable electronics, sounders, and strobe lamps that can be used in the units are well-known. The bases 110 and 210 are identical 5 in most respects, and the same reference numerals used for the base 110, increased by 100, are applied to the base 210.

The base 110 of the audible alarm unit 100 has peripheral side walls 112, the rear edge portions 112*e* of which are of a honeycomb construction with two wall segments joined by cross-ribs, thus making the perimeter of the base strong and rigid. The rear edges 112*re* of the side walls lie in a plane so as to engage a wall adjacent a backbox. The front wall of the base 110 is formed by several generally planar wall portions that lie parallel to the rear edges 112*re* of the side walls, to wit:

A rectangular (in plan) screw land wall portion 114 in each corner, each having two screw holes 116 and 118, each of which is surrounded internally and externally by stiffening ribs and is configured and positioned to permit the base 110 to be attached to the several forms of backboxes that are in current use. Reference may be made to patent application Ser. No. 08/524,865 referred to above for a further description of suitable arrangements of sets of screw holes. The screw land wall portions 114 are located intermediate of the rear edges and the frontal extremity of the base to permit the use of relatively short screws.

A support wall portion 116 for a terminal block receptacle 118, which extends rearwardly toward the backbox and is configured to accept terminal blocks with screws for connecting the electronics unit of the alarm with wire pairs coming into and, often, leaving the backbox.

A main front wall portion 120, which defines in part a cavity in the base 110 for the electronics unit and a sounder (neither shown) and has a hole 122 to enhance the propagation of sound into the space in which the alarm is installed. The main front wall portion 120 is connected to the screw land wall portions 114 and the terminal block support wall portion 116 by connecting walls 124, 126 that lie substantially perpendicular to the rear edge plane of the base (but at a small angle for better ejection from the mold) and to portions of the side walls 112 by beveled wall portions 128.

A projecting wall portion 130, which is rectangular in plan, has a generally planar portion 130*p* and beveled end portions 130*b* at each end of the planar portion 130*p* and out from adjacent wall portions such that it is received in the hole 26 in the cover 20 (see FIG. 1) with its frontal surfaces generally flush with the surfaces of the cover that border the hole 26. The external surface of the projecting wall portion 130 has a semi-circular, raised plain surface portion 130*r* that adjoins the faux grille (ribs 34) of the cover to form a circular motif and parallel ribs 132 that form a faux grille adjoining and aligned with the ribs 28 on the cover 20. The faux grille on the projecting portion and the cover visually masks the edges of the hole 26 and the projecting wall portion 130. The projecting wall portion 130 is joined to the main front wall portion 120 by a lower connecting wall 134 and to the wall portions 114 by an upper connecting wall 136, the latter being stiffened by ribs 138.

The side of the base 100 that faces the wall and the backbox (see particularly FIGS. 12 to 14) has, in addition to the terminal block support 118 described above, the following elements:

Three resilient mounting arms 140, which receive in a snap-in relation and secure by resilient engagement a circuit board carrying the sounder and the electronics for driving the sounder (neither shown). Each arm 140 has a hook portion 140*h* for capturing the edge of the board and abutment portions 140*h*, one on each side of the hook portion, that have shoulders on which the edge of the board rests. The hook portion of each arm is formed by a boss in the female mold, thus leaving a slot 140*s* in the base adjacent the juncture of each hook portion and the wall of the base from which the hook portion projects (see FIG. 14, at the right).

Five posts 142, each with a star-ribbed tip, for affixation by a press-fit/interference-fit of an electrically-insulating cover board (not shown), that covers the rear of the base 110 and has holes for the screws by which the base is attached to the backbox and for the terminal block support 118. The cover card has holes that receive the posts and is retained frictionally by engagement of the walls of the holes with the ribbed tips.

The cover 20 snaps onto the base 110 and is retained by projecting pairs of lugs 150 on each side of the base 110 and an inwardly projecting rib So on each side of the cover 20 that is captured behind (with respect to the frontal aspect of the base) the lugs on the base. A slot 52 adjacent each rib 50 accepts a screwdriver tip or other implement to facilitate displacing the edge of the cover outwardly to release it from the base.

Figure 19:
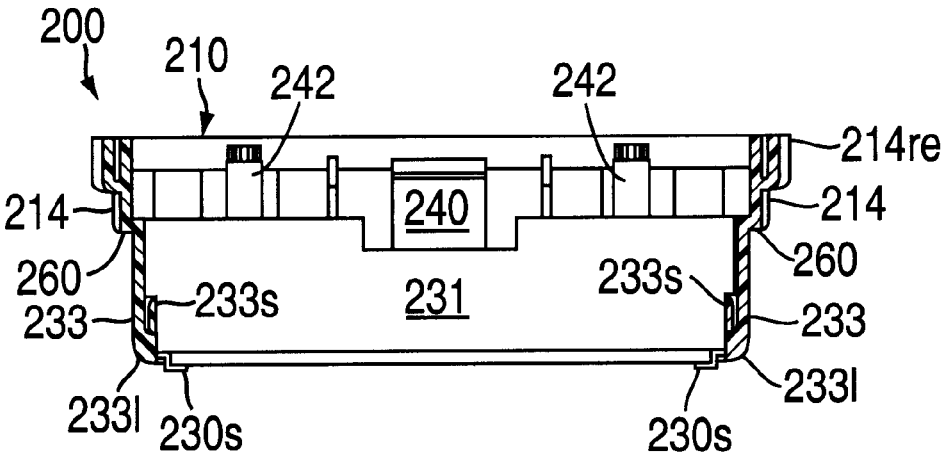
FIG. 19 is a bottom cross-sectional view of the base member of FIG. 15, taken along the lines 19—19 is FIG. 18.

As mentioned above, the base 210 of the audible/visible alarm 200 (FIGS. 15 to 19) is the same as the base 110 of the audible alarm 100. The only difference is that the projecting wall portion 130 of the base 110 is replaced by a receptacle 230 for a strobe light unit. The receptacle 230 has side walls 231 that form junctures with the wall portions 214, 216 and 220 and end walls 233 that form junctures with narrow connecting wall portions 260 joined to the side walls 214 (FIG. 19). The walls 231 and 233 lie substantially perpendicular (but at a small angle for better ejection from the mold) to the rear plane (defined by the edges 212*re*) of the base 210. The front edges of the walls 231 and 233 define an opening 235 that accepts a strobe light unit 300 (See FIG. 2), which is known per se and can be of various configurations. Typically, a strobe lamp unit has a base plate that carries a reflector and a strobe lamp that is supported by the reflector in a predetermined position relative to the reflector. The base, reflector and lamp are covered by a transparent cover 302 (see FIG. 2), which is, preferably, molded from an optical grade "Lexan®". A suitable strobe lamp unit is described and shown in U.S. Pat. No. 5,475,361, issued Dec. 12, 1995, and entitled "Strobe Warning Light," which is hereby incorporated by reference. The edges of the lamp unit receptacle 230 that define the opening have lips 231*l* and 233*l* for positioning the cover on the end walls of the receptacle 230, the edge of the cover resting on the edge of the receptacle outwardly of the lips 231*l* and inwardly of the lips 233*l*. A resilient snap-fit hooked arm at each end of the cover snaps under a projecting, rearwardly facing shoulder 233*s* on the inner surface of the end wall 233 of the receptacle. The base of the lamp unit is captured between shoulders on the cover, tabs on the reflector, and a shoulder 230*s* at each corner of the receptacle 230. Other arrangements for attaching a strobe lamp unit can be used with the receptacle 230.

The receptacle 230 of the base 210 is received through the opening 26 in the cover 20, as shown in FIG. 2, the light unit thus projecting out from the cover a substantial distance to enable light from the strobe lamp to be directly projected from the lamp and also reflected from the reflector into the space in which the alarm is located. Obviously, the electronic unit (not shown) of the unit audible/visible alarm unit 200 has circuitry for both driving the sound generator and firing the strobe lamp. The electronic unit is on a circuit board that is supported on the base in the manner described above in connection with the audible alarm unit 100.

Figure 20:
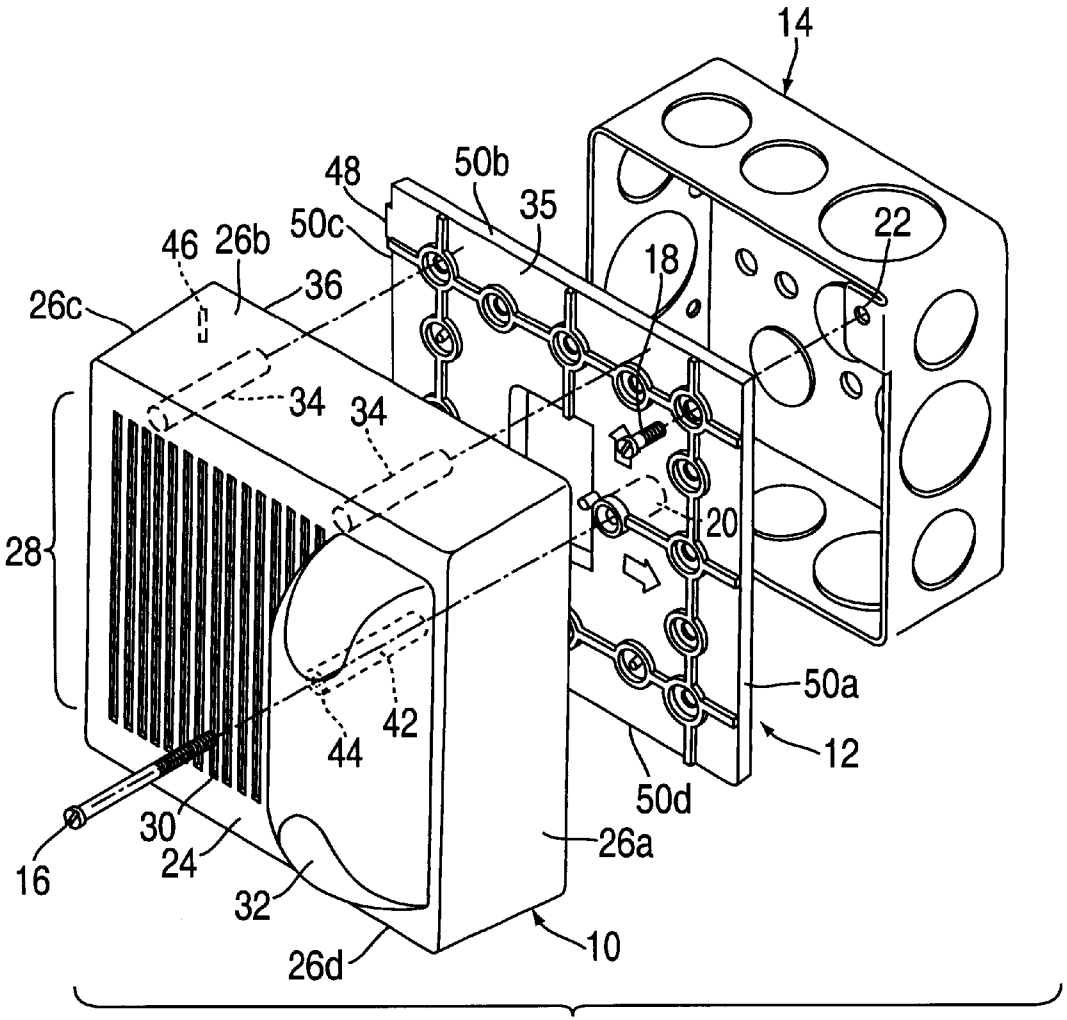
FIG. 20 is an expanded perspective view of one embodiment of an alarm cover, mounting plate and backbox assembly in accordance with the invention.

In the illustrative embodiment of the invention shown in FIG. 20, an audible-visual alarm assembly includes an alarm cover 10, a mounting plate 12 and a backbox 14. As described more fully hereinafter, the cover 10 is secured to the mounting plate 12 by a single fastener 16, and the mounting plate 12 is in turn secured to the backbox 14 by one or more fasteners 18. For simplicity and ease of installation, the fasteners 16 and 18 are preferably bolts, which are received by a threaded receptacle 20 in the mounting plate 12 and the conventional threaded openings 22 (only one of which is shown) in the backbox 14, respectively. Alternatively, other fasteners, such as self-tapping screws, may be used.

It is a feature of the invention that the mounting plate 12 enables the alarm cover 10 to be attached to all standard backboxes, including the single-gang box, the double-gang box (either surface mounted or wire mold mounted), the 4-inch box and the international (100 mm) box. By way of illustration, FIG. 20 depicts a 4-inch backbox (4 inches square). The manner of attachment of the plate 12 to the other types of backboxes is described hereinafter.

When attached to a wall, the alarm assembly may be 5 surface mounted, in which case the backbox 14 is attached directly to the wall surface, flush mounted, in which case the backbox 14 is recessed within the wall and the back edge of the cover 10 abuts the wall surface, or semi-flush mounted, in which case the backbox is recessed as before but an extender is inserted between the backbox and the back edge of the cover 10 to offset it from the wall surface by a desired distance. If an extender were employed with the assembly of FIG. 20, it would be located between the mounting plate 12 and the backbox 14 and secured thereto by the fasteners 18. Alternatively, the box may be wire mold mounted.

As shown in FIG. 20, the audible-visual alarm cover 10 is preferably square in outline, having a front wall 24 and four perimeter side walls 26*a*, 26*b*, 26*c* and 26*d*. The side wall length is somewhat larger than the largest backbox to be fitted, in this case the 4-inch backbox. The front-to-back depth of each sidewall is sufficient to accommodate receipt of the audible and visual alarm generating units (not shown), which are conventional, within the cover 10. In a typical audible-visual alarm, the audible alarm unit includes a piezoelectric transducer and associated electronics and the visual alarm unit includes a strobe lamp and associated electronics. The strobe lamp typically would include a flash tube and a reflector.

The region 28 of the front wall 24 overlying the audible alarm generating element is formed as a grille which transmits sound, while preferably presenting a solid appearance when viewed frontally. To that end, the grille is preferably comprised of a plurality of parallel, elongated recesses 30 in the front wall 24, with at least one longitudinal side wall of each recess being apertured in a direction parallel to the front wall 24 for sound transmission purposes.

A transparent or translucent strobe lens 32 is mounted on the front wall 24, overlying a front-to-back opening (not shown) in the wall 24 for receipt of the strobe lamp and associated components of the alarm. For ease of assembly, the strobe lens 32 preferably snap-fits within the opening. In the alarm orientation depicted in FIG. 20, the strobe lamp and lens 32 are oriented in the vertical direction. They may alternatively be oriented in the horizontal direction. As described hereinafter, cooperating Structure on the cover 10 and the mounting plate 12 accommodates and facilitates either orientation.

As shown generally in FIG. 20 and in more detail in FIGS. 21–24, the mounting plate 12 is substantially square in outline, and preferably is slightly smaller in size than the open back side of the cover 10 so as to fit snugly therewithin and substantially close the back side thereof. A plurality, e.g. four, supporting posts 34 extend rearwardly from the inside of the front wall 24 of the cover and terminate short of the back edge 36 of the side walls 26*a*–26*d* by approximately the thickness of the mounting plate 12. The posts 34, only two of which are shown (the other two would be located at the bottom of the cover 10 in FIG. 20 directly below the two shown), abut the front surface 35 of the plate 12 and position it so that the rearmost perimeter edge 40 of the plate 12 (FIGS. 22 and 23) is substantially even with the back edge 36 of the cover 10.

A front-to-back extending tubular member 42 is also provided on the front wall 24 of the cover 10. The member 42 is located so as to be in alignment with the receptacle 20 on the mounting plate 12 when the plate 12 is inserted in the back side of the cover 10. An opening 44 in the front wall of the cover 10 connects with the hollow interior of the tubular member 42 for passage therethrough of the fastener 16. The opening 44 and associated tubular member 42 advantageously constitute the only opening through the cover 10 for fastening the cover to the mounting plate 12. If desired, however, additional tubular members and openings may be provided to cooperate with corresponding additional receptacles on the plate 12.

The opening 44 and tubular member 42 are preferably located adjacent to the interior side of the strobe lens 32 at substantially the vertical midpoint (as viewed in FIG. 20) of the cover 10. The sidewall 26*c* of the cover 10 located opposite to the sidewall 26*a* adjacent the strobe lens 32 is formed with at least one mounting element, e.g., a recess 46, and preferably two or more such elements in the inner surface thereof. Each element or recess 46 is located adjacent the rear edge 36 of the cover, and receives a cooperating element, e.g., a tab 48, on the corresponding side 50*c* of the mounting plate 12. The mounting elements 46 and 48 may take forms other than recesses and tabs, but preferably are designed to permit rapid assembly of the cover 10 and the plate 12.

Figure 21:
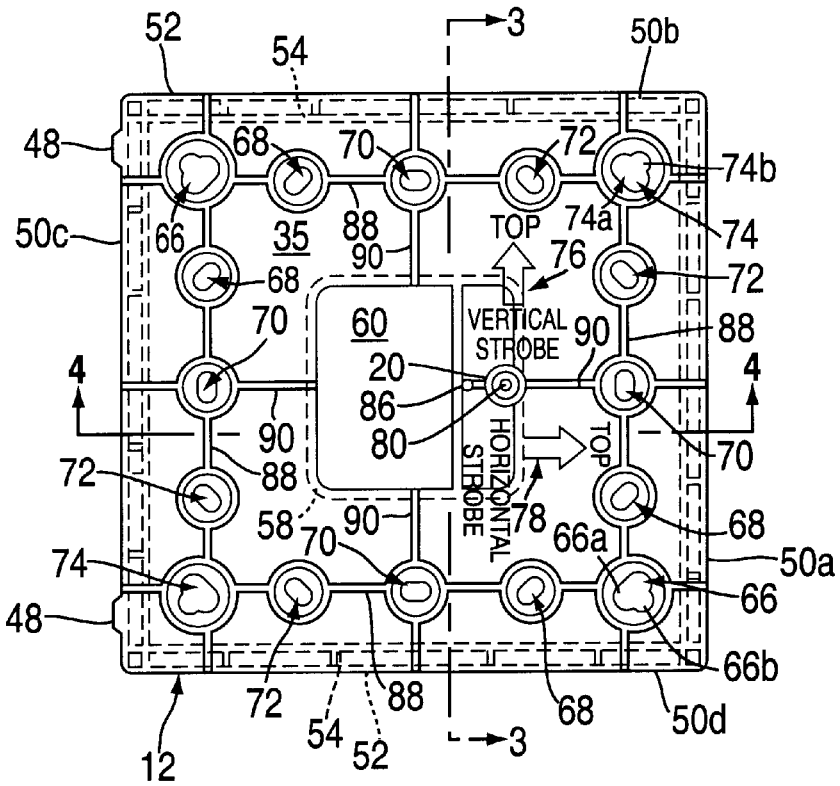
FIG. 21 is a front view of the mounting plate of FIG. 20.

If only a single recess 46 and tab 48 are provided, they are preferably located centrally of the cover 10 and plate 12 on a line with the fastener opening 44 and the receptacle 20. If two (or more) cooperating recesses 46 and tabs 48 are provided (as illustrated in FIGS. 20 and 21), the recesses 46 and tabs 48 are preferably spaced apart symmetrically along the length of the side wall 26*c* and plate side 50*c*, respectively, relative to the fastener opening 44 and the receptacle 20. The receptacle 20 is preferably located on the bisector of the opposite plate side 50*c*. When the tab or tabs 48 of the mounting plate 12 are inserted into the cooperating recess or recesses 46 of the cover 10, the mounting plate 12 fits within the back of the cover 10 with the receptacle 20 in alignment with the tubular member 42 and the opening 44 for receipt of the fastener 16. Hence the cover 10 may readily be attached to the mounting plate 12 by means only of the tabs 48 and recesses 46 and the single fastener 16. This greatly facilitates easy and error-free assembly of the alarm cover 10 on the plate 12.

Because the alarm cover 10 carries the alarm generating components in the embodiment of FIGS. 20–24, it is preferable for security purposes that the cover 10 be bolted to the mounting plate 12. If desired, however, the cover 10 could be attached to the plate 12 in other ways, e.g., by a snap fit. Any suitable structure, such as that shown in the embodiment of FIGS. 25–29, could be provided for that purpose.

The preferred embodiment of the mounting plate 12 is partially shown in FIG. 20 in juxtaposition to the alarm cover 10, on the one hand, and the backbox 14, on the other hand. The plate is shown in more detail in FIGS. 21–24. Like the cover 10, the mounting plate is preferably square in outline, having equal length sides 50*a*, 50*b*, 50*c* and 50*d*. Both the alarm cover 10 and the mounting plate 12 are preferably injection molded from a high-impact resistant and flame retardant plastic, such as acrylonitrile, butadiene styrene, or the like.

The plate 12 may be formed with double, rearwardly extending perimeter walls 52 and 54 for reinforcement and to provide a tight fit with the wall surface around the periphery of the backbox 14. To that end, the inner wall 54 is preferably slightly longer than the outer wall 52 (see FIGS. 22 and 23). Cross reinforcement ribs 56 may be formed between the walls 52 and 54 for added strength. The back of the plate 12 is otherwise flat, except for a rearwardly extending flange 58, which partly surrounds a central front-to-back opening 60 in the plate, and the rearwardly extending receptacle 20. The opening 60 is bounded on the side adjacent to the receptacle 20 by a rearwardly extending cross piece 62 of the same depth as the flange 58. Triangularly shaped members 64 may be formed integrally with the plate proper and the receptacle 20 to reinforce the receptacle. For a like purpose, the flange 58 preferably extends around and merges into the receptacle 20, as best shown in FIGS. 23 and 24. The opening 60 is sized and positioned to permit an electrical connection to be established from all standard backboxes 14 through the plate 12 to the alarm generating units within the cover 10. Preferably, the opening is sufficiently large to accept passage therethrough of the terminal block for the alarm generating units.

Viewed from the front (FIG. 21), the plate 12 is seen to have a plurality of front-to-back openings 66, 68, 70, 72 and 74 along each side of the plate 12. In accordance with the invention, the openings 66–74 are positioned and arranged to accommodate the mounting bolt placements for all standard backboxes, including the single-gang box, dual-gang box, the 4-inch box and the international (100 mm) box. Thus the endmost openings 66 and 74 are sized and positioned to receive therethrough mounting bolts or screws 18 for the 4-inch backbox and the 100 mm backbox. To that end, each end opening 64 and 74 preferably has an oval-shaped base opening 66*a*, 74*a* that is inclined at approximately 45% to the adjacent plate sides, e.g., 50*a*, 50*b*, and a generally circular opening 66*b* and 74*b* that joins the base opening 66*a* and 74*a*, respectively, and extends outwardly from the center of the plate along a diagonal of the plate. This configuration of the end openings 66, 74 provides sufficient space and maneuverability to accommodate the mounting bolt placement on both the 4-inch backbox and the international (100 mm) backbox. The inclination of the oval-shaped base opening 66*a*, 74*a* also permits the mounting plate 12 to be rotated somewhat to allow the cover 10 to be mounted plumb even though the backbox is slightly askew.

The intermediate openings 68, 72 located adjacent to the end openings 66, 74 are substantially identical oval-shaped openings that are positioned for mounting the plate 12 to a standard double-gang backbox. The openings 68, 72 are also preferably inclined relative to the adjacent plate side 50*a*–50*d*, but at approximately one-half the inclination of the base openings 66*a*, 74*a* of the end openings 66, 74, i.e., at approximately 22½.degree. to the adjacent plate side. Also, the two openings 68, 72 along each plate side are preferably inclined in opposite directions, so that each is inclined towards the center of the adjacent side. The combination of the oval-shape and the inclination of each opening 68, 72 permits the mounting plate 12 to be angled somewhat relative to the double-gang backbox, should this be necessary in order to mount the cover 10 in a plumb condition on the wall.

Finally, the center openings 70 are preferably oval-shaped and parallel to the adjacent plate sides 50*a*–50*d*. The openings 70 are positioned at the midpoints of the plate sides and are adapted to mount the plate 12 to a single-gang backbox. The oval shape of the openings 70 accommodates some relative displacement between the plate and the backbox to accommodate out-of-plumb or otherwise misaligned backboxes.

As noted, it is a feature of the invention that the mounting plate 12 may be attached to a backbox 14 for either horizontal or vertical orientation of the strobe lens 32. For that purpose, the openings 66–74 are identically arranged along each side of the plate 12. No matter which side of the plate is up, therefore, the openings 66–74 will be correctly positioned relative to the backbox for attachment of the plate to the backbox using the standard bolt placements.

To facilitate correct assembly of the mounting plate 12 to the backbox for either vertical or horizontal strobe orientation, the front surface 38 of the plate 12 is preferably formed or marked with indicia which indicate to the installer how the plate is to be attached to the backbox to provide the desired strobe orientation. Such indicia are shown in FIG. 20 at 76 for the vertical strobe orientation and at 78 for the horizontal strobe orientation. As shown, the indicia preferably include one or, preferably, both arrows and words, which unequivocally indicate which side of the plate 12 should be uppermost, i.e., at the top, when the plate is attached to the backbox. With the plate oriented and attached to the backbox in this manner, the mounting tabs 48 will necessarily be correctly positioned to orient the alarm cover 10 (and strobe lens 32) correctly when the recesses 46 in the cover wall 26*c* are brought into engagement with the tabs 48. It will be understood, of course, that other forms of indicia may be provided, so long as the correct orientation of the plate is clearly indicated. Also, the indicia 76 could be used to indicate a desired orientation of a feature of the alarm other than the strobe.

Figure 22:
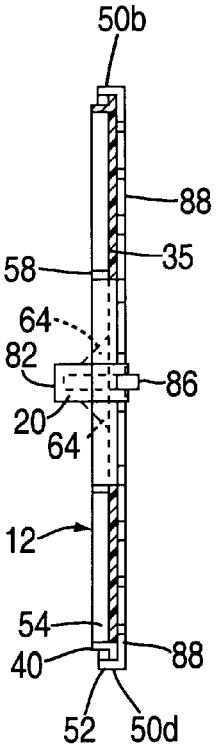
FIG. 22 is a sectional view taken along the line 3—3 of FIG. 21 and looking in the direction of the arrows.
Figure 23:
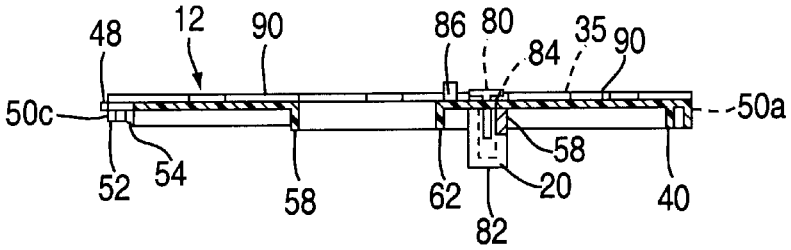
FIG. 23 is a sectional view taken along the line 4—4 of FIG. 21 and looking in the direction of the arrows.
Figure 24:
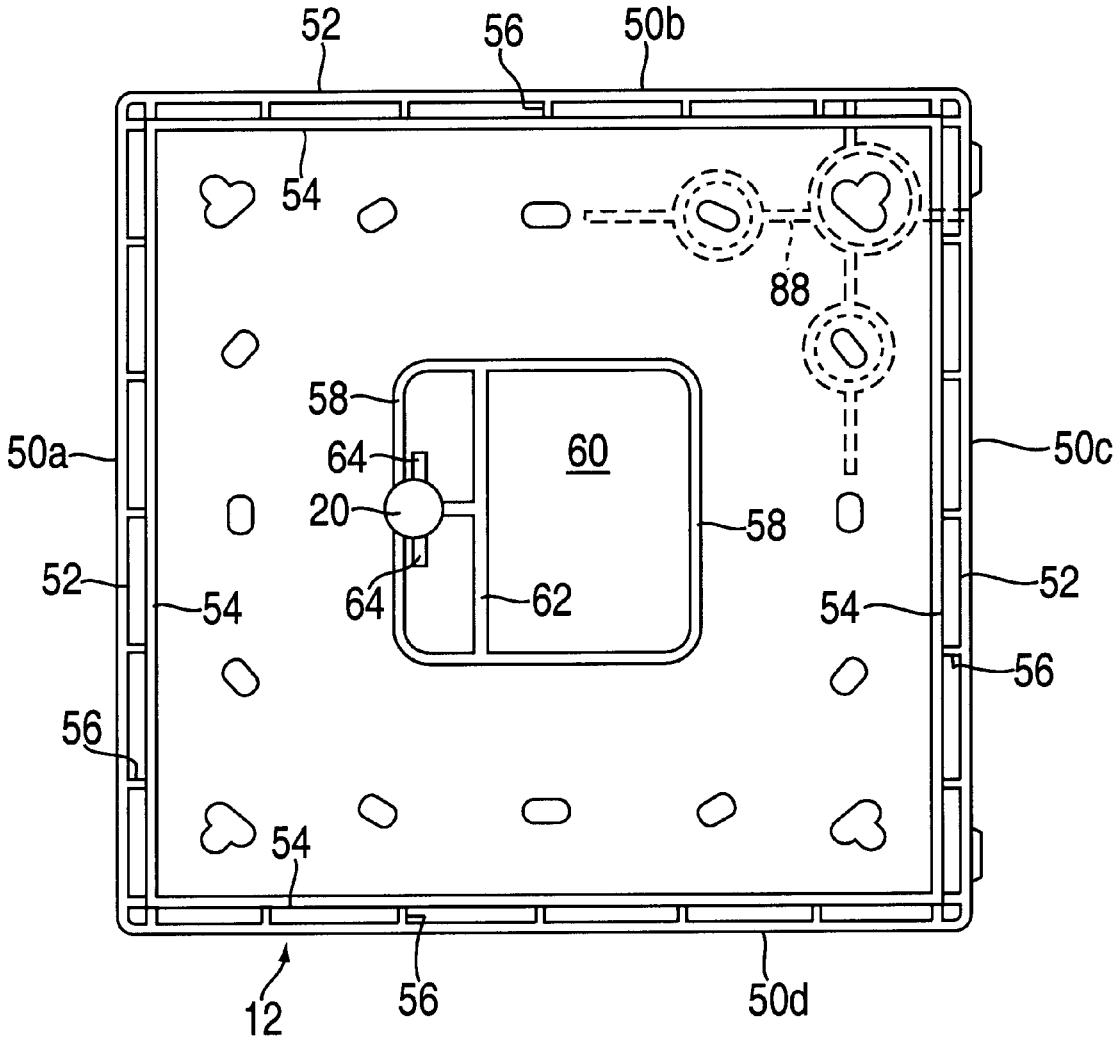
FIG. 24 is a back view of the mounting plate of FIG. 21.
Figure 25:
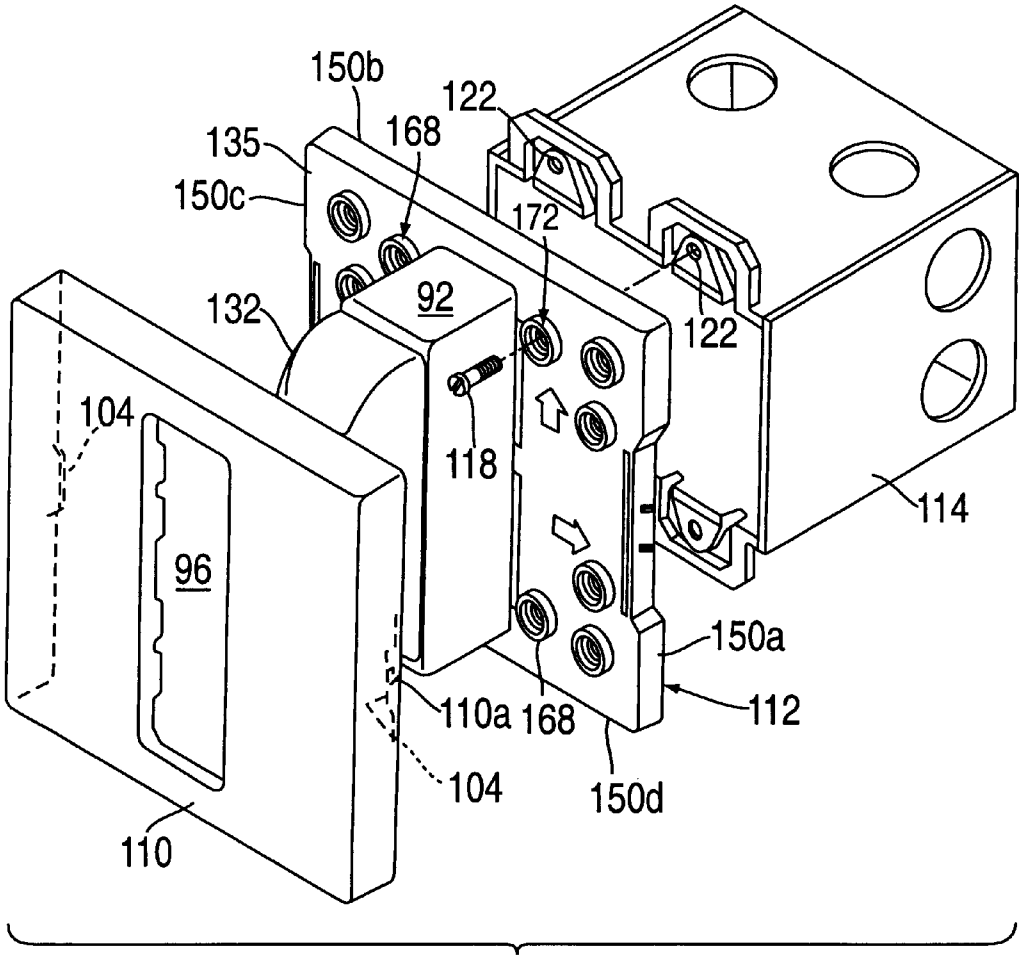
FIG. 25 is an expanded perspective view of another embodiment of an alarm cover, mounting plate and backbox assembly in accordance with the invention.
Figure 26:
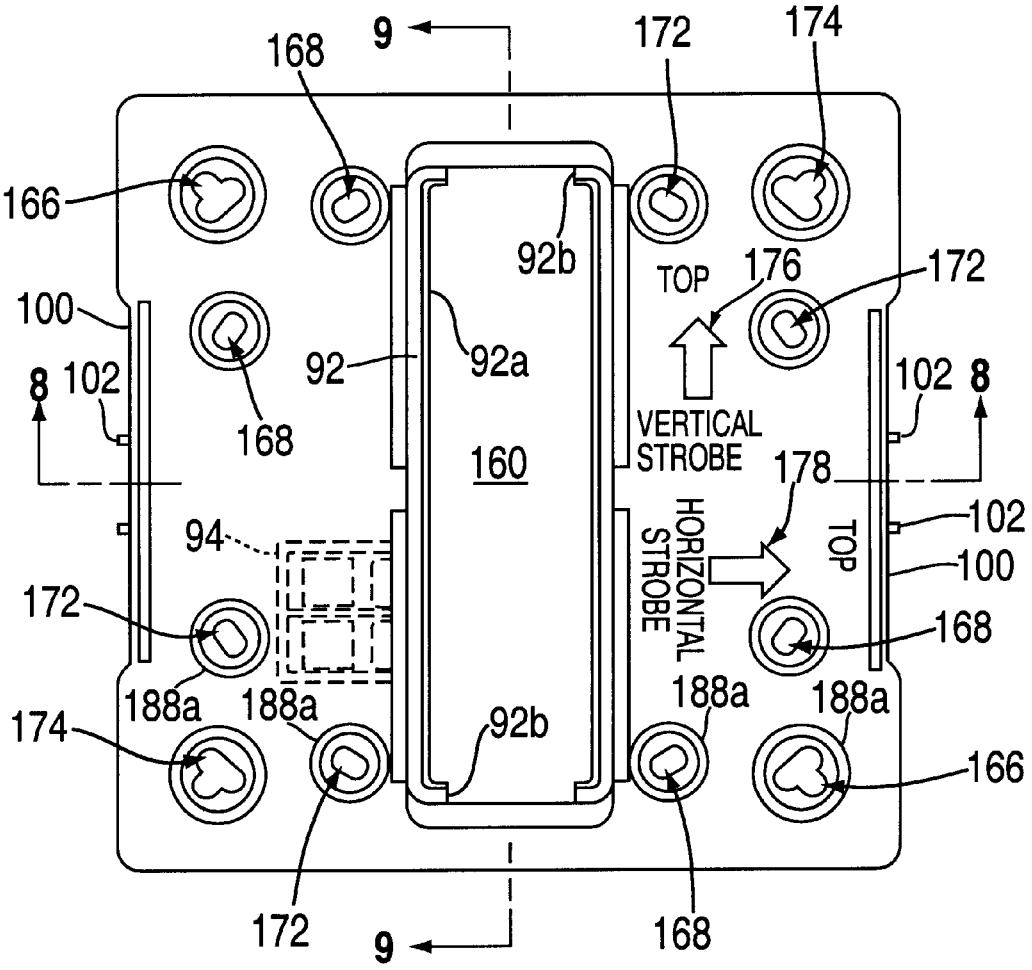
FIG. 26 is a front view of the mounting plate of FIG. 25.
Figure 27:
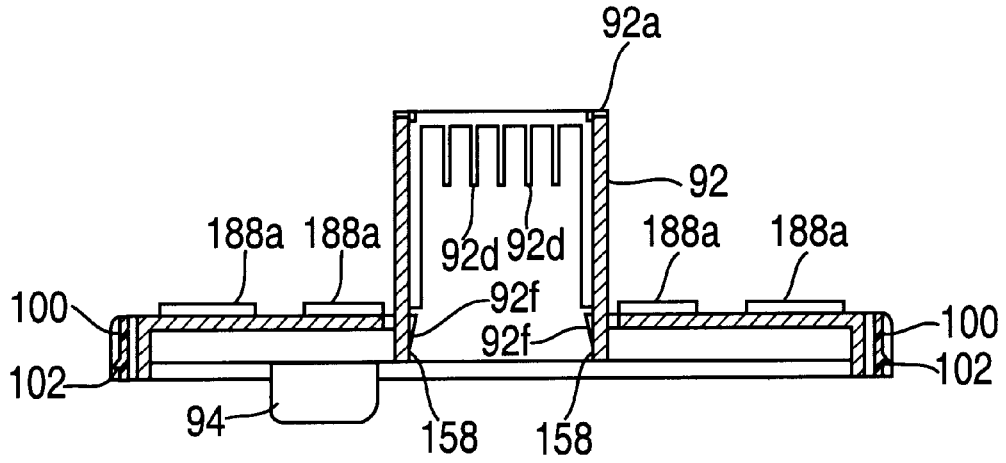
FIG. 27 is a sectional view taken along the line 8—8 of FIG. 26 and looking in the direction of the arrows.
Figure 28:
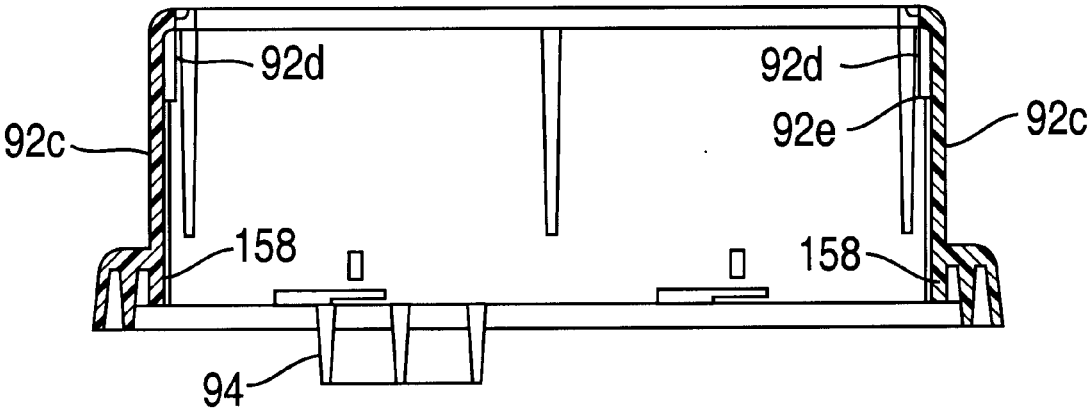
FIG. 28 is a sectional view taken along the line 9—9 of FIG. 26 and looking in the direction of the arrows.
Figure 29:
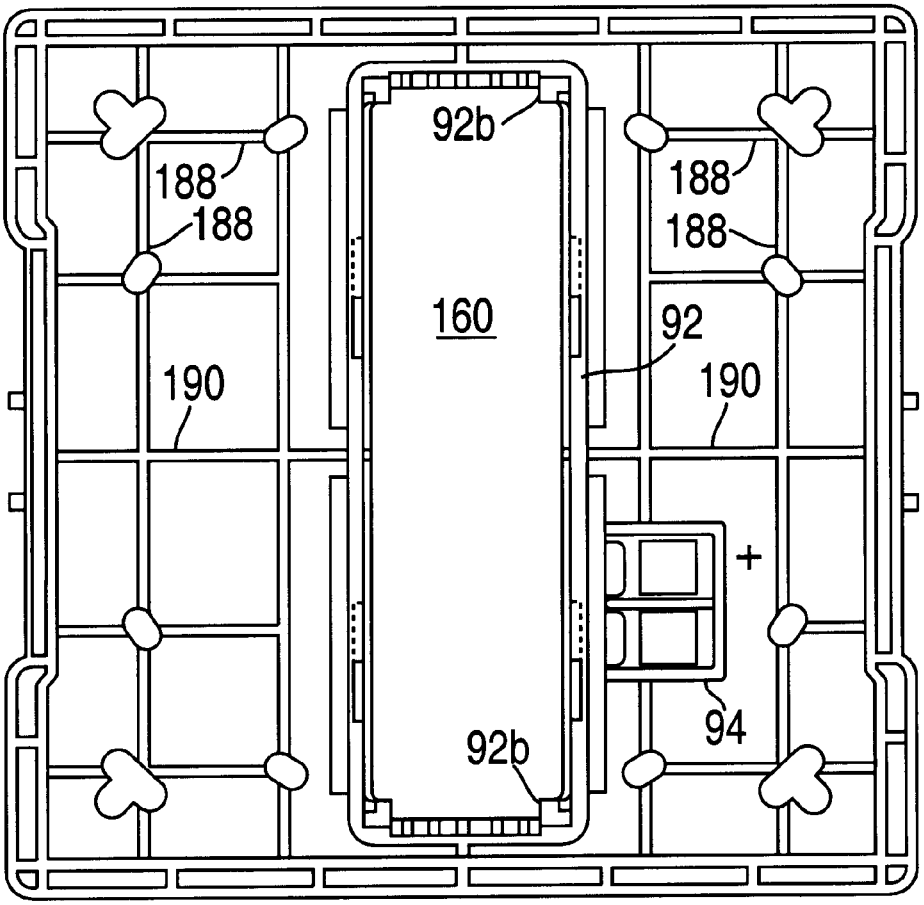
FIG. 29 is a back view of the mounting plate of FIG. 26.
Figure 30:
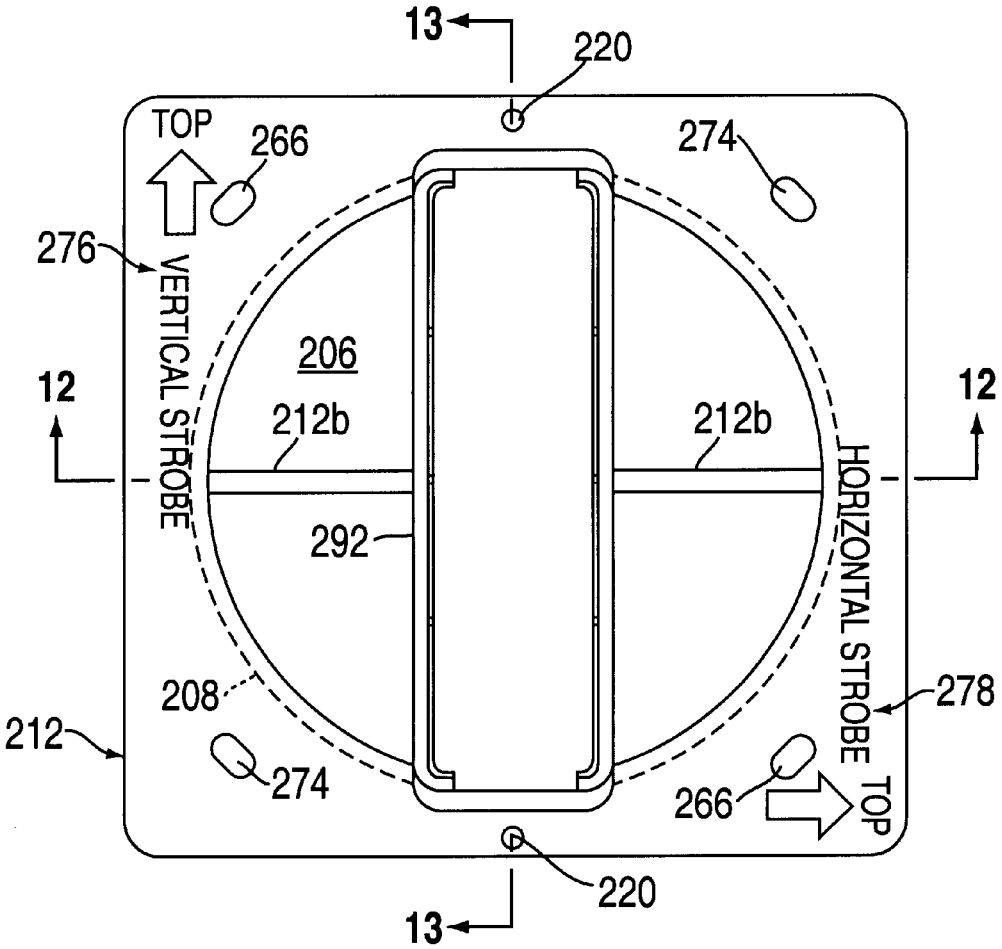
FIG. 30 is a front view of still another embodiment of a mounting plate in accordance with the invention.
Figure 31:
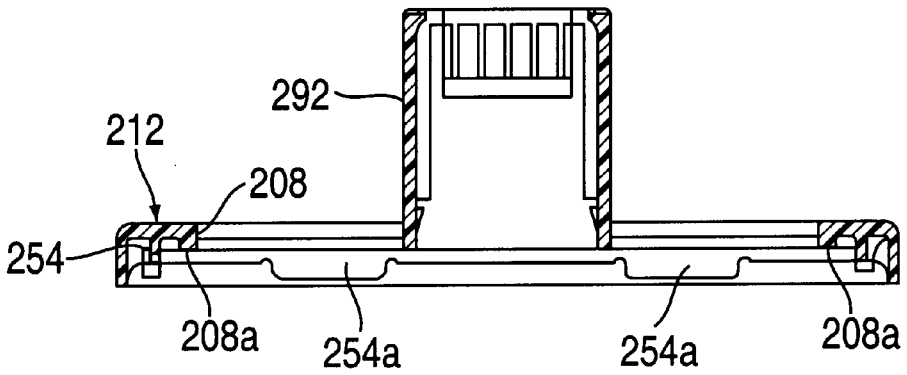
FIG. 31 is a sectional view taken along the line 12—12 of FIG. 30 and looking in the direction of the arrows.
Figure 32:
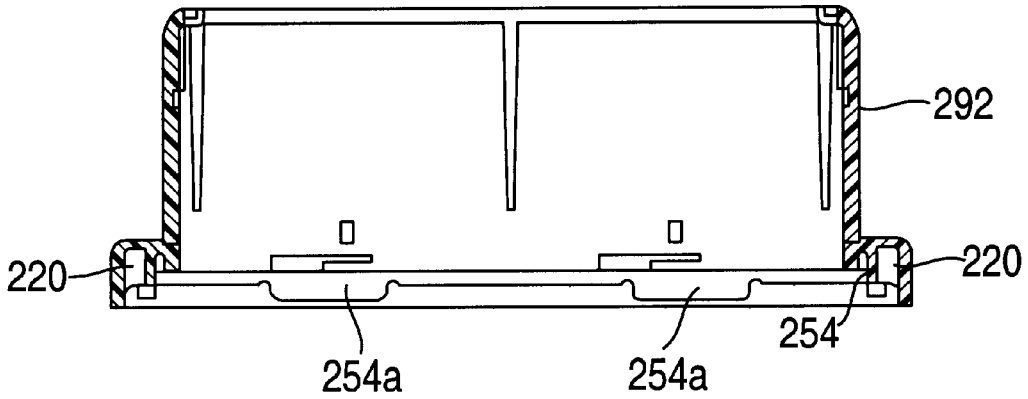
FIG. 32 is a sectional view taken along the line 13—13 of FIG. 30 and looking in the direction of the arrows.
Figure 33:
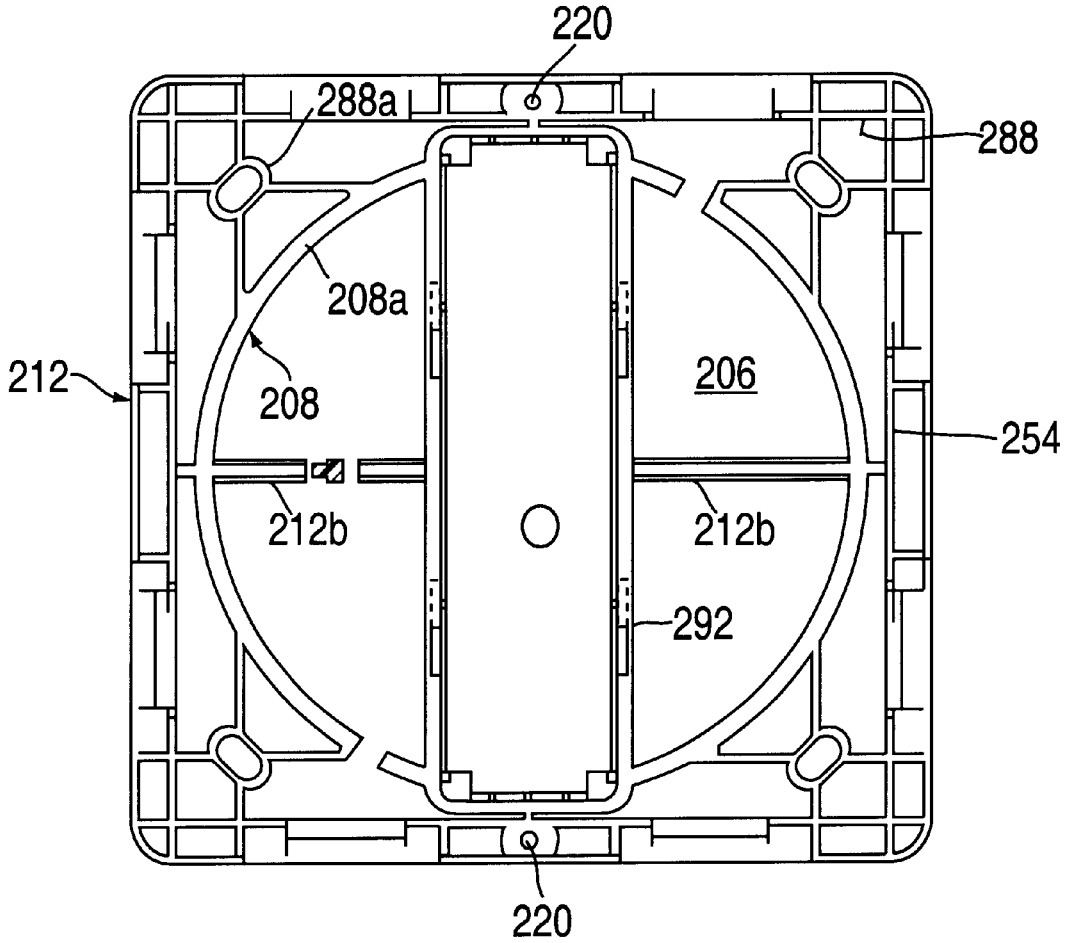
FIG. 33 is a back view of the mounting plate of FIG. 30.

As shown in FIGS. 21–23, the receptacle 20 for the mounting fastening 16 opens, as at 80, through the front surface 35 of the plate 12 and preferably is closed at the back end 82. To facilitate alignment of the tubular member 42 on the cover 10 with the receptacle 20, the opening 80 is preferably surrounded by a inwardly beveled lip 84 (FIG. 23), which serves to center the back end of the member 42 on the opening 80.

An upright pin 86 is preferably formed on the front of the plate 12 adjacent to the receptacle 20. Its purpose is to abut the back side of the PC board (not shown), which fits within the alarm cover 10 and carries the electronics for the alarm, to provide support for the board. Additional support pins may be provided if desired. Also, the pin or pins 86 may be located at positions different from that shown in the drawings.

If desired, structural reinforcement may be provided for the plate 12 by forming protruding ribs 88 which extend across the full length of each side 50*a*–50*d* and which encircle the openings 66–74. Ribs 90 may also be formed centrally of the plate 12 to provide additional reinforcement if desired. The ribs 88 and 90 may be omitted if structural reinforcement of the plate is not needed.

Another embodiment of the invention is depicted in FIGS. 25–29, wherein like parts are identified by the same reference numbers as in FIGS. 20–24 increased by one hundred. The alarm assembly includes an alarm cover 110, a mounting plate 112 and an electrical backbox 114. The backbox 114 is, in this instance, of the double-gang type, having correspondingly located threaded openings 122 for receipt of threaded fasteners 118.

The mounting plate 112 is similarly sized and shaped as the plate 12 of FIG. 20. It includes along each side 150*a*, 150*d*, 150*c* and 150*d* a plurality of openings for passage therethrough of the threaded fasteners 118. As more fully shown in FIGS. 26 and 28, the endmost openings 166, 174 along each plate side are preferably positioned and configured in the same manner as in the embodiment of FIGS. 20–24, i.e., so as to match up with the threaded openings of the 4-inch and international backboxes. The intermediate openings 168, 172 along each plate side are likewise preferably arranged as in FIGS. 20–24, i.e., to match up with the threaded openings of the double-gang backbox. Hence, in FIG. 26 the threaded openings 122 of the double-gang backbox 114 are shown aligned with the intermediate openings 168, 172 spaced along the sides 150*b*, 150*d* of the mounting plate 112. As in the earlier embodiment, the endmost openings 166, 174 and the intermediate openings 168, 172 preferably include oval-shaped, inclined portions to accommodate out-of-plumb backboxes.

Although no central openings corresponding to the central openings 70 of the plate 12 are provided in the plate 112, the plate 112 nonetheless can be mounted to a single-gang backbox by use of the intermediate openings 168 or 172. In such case, the plate 112 will be horizontally offset relative to the backbox 114, but it will still cover the relatively narrow single-gang backbox.

In FIGS. 20–24, the reinforcing ribs 88, 90 are located on the front side of the plate 12. If desired, these ribs could be formed on the back surface of the plate, and in the embodiment of FIGS. 25–29 they are shown on the back surface of the plate 112 at 188, 190. Preferably, a circular reinforcing rib 188*a* surrounds each opening 166, 168, 172, 174 on the front side of the plate 112. Such circular ribs may, however, also be provided on the back side of the plate or eliminated altogether if reinforcement is not needed.

Unlike the previous embodiment, where the alarm generating components and the strobe lens 32 are carried by the alarm cover 10, in the embodiment of FIGS. 25–29, which is a visual alarm only, the strobe lamp and electronics and the strobe lens 132 are carried by the mounting plate 112. To that end, an elongated upstanding base 92 is integrally formed on the plate 112 in surrounding relation to the enlarged front-to-back opening 160 in the plate. The opening 160 is surrounded on the back side of the plate 112 by an integral flange 158.

The open forward end 92*a* of the base 92 is formed at either longitudinal end with a recess 92*b* for receipt of a depending resilient tongue (not shown) on the corresponding end of the strobe lens 132 (not shown in FIGS. 26–29). The end walls 92*c* of the base 92 are formed with ribs 92*d* which extend rearwardly from the open forward end 92*a* and terminate in a shoulder 92*e* behind which detents on the ends of the tongues of the strobe lens 132 snap to attach the lens 132 to the plate 112.

The strobe lamp (which is conventional and not shown) is inserted into the base 92 through the open back side thereof and preferably is snap-fitted into place. For that purpose, detents 92*f* may be formed on the interior of the base 92*a* adjacent the back side thereof.

If desired, a mounting receptacle 94 may be formed on the back side of the plate 112 for the electronics associated with the strobe lamp. In this way, all of the components of the electronic strobe unit will be carried by the plate 112, requiring only electrical leads to connect to line power via the backbox 114 and an essentially decorative cover 110 to conceal the mountings openings 166, 168, 172, 174, fasteners 118 and other functional components of the plate 112. The cover 110 may take any convenient shape, e.g. square or circular, and may be of approximately the same size as the plate 112 (as shown in FIGS. 25–29) or it may be larger, as would be the case, for example, where a circular cover is used. The cover 110 is formed with an opening 96 shaped to fit over the base 92 of the plate 112, so that, when assembled, it fits snugly over the base and against the front surface of the plate 112.

Where the shape of the cover 110 permits, it preferably is configured to snap-fit onto the plate 112. In the embodiment of FIGS. 25–29, for example, the sides 150*a*, 150*c* of the plate 112 that parallel the length of the base 92 may be formed with a flexible strip 100 and cam-forming members 102 which cooperate with detents 104 on the corresponding inner walls of the cover 110. As the cover 110 is pushed onto the plate, the detents 104 on the cover walls engage the cam members 102, which are beveled rearwardly, and cam the strips 100 inwardly. The strips 100 and cam members 102 then snap back behind the detents 104 to capture the cover 110 on the plate 112. Slots 110*a* may be provided in the walls of the cover 110 for access by a screw driver or other tool when it is desired to remove the cover. Alternatively, the cover 110 may be bolted or otherwise secured to the plate 112.

Because strobe lamps are often directional in their light output, it is important that the lamp not be installed upside down. Hence, as in the prior embodiment, indicia 176, 178 in the form of arrows and/or words are provided on the front surface of the plate 110 to guide the installer in the correct attachment of the plate to the backbox.

Mounting the alarm-generating components on the mounting plate, rather than on the cover, affords further economies in manufacture, inventory and installation relative to prior alarms and relative to the embodiment of FIGS. 20–24. The same basic mounting plate structure can be employed for all alarms of a given type, and the alarm can then be customized to a particular application merely by changing the relatively inexpensive cover 110.

In the embodiment of the mounting plate of FIGS. 30–33, wherein like parts are identified by the same reference numbers as in FIGS. 20–29 increased by two hundred, the mounting plate 212 is configured to carry both the visual and the acoustic alarm generating components. Thus, as in FIGS. 25–29, the plate 212 is formed with an upstanding base 292 for a strobe lamp, and also is formed with a central aperture 206 surrounded by a circular flange 208 behind which a speaker (not shown) is to be mounted. The periphery of the speaker abuts against the rear surface 208*a* of the flange 208, and preferably is held in place by ultrasonic welding of tabs 254*a* formed on the rear of the inner peripheral wall 254 of the plate 212. The strobe base 292 spans the aperture 206 and is reinforced at the midpoint by transversely extending ribs 212*b*.

As in the earlier embodiments, indicia 276, 278 are provided on the front surface of the plate 212 to indicate the correct orientation of the plate when it is attached to the backbox.

As in the embodiment of FIGS. 25–29, an alarm cover (not shown) fits over the strobe base 292 and is attached to the plate 212, as, for example, by threaded fasteners (not shown) received by openings 220 formed in or through the plate. The cover may be approximately the same size as the plate or larger, and it may be square, circular or any other desired shape. To facilitate sound transmission, the area of the cover overlying the aperture 206 is preferably perforated or slotted.

As the mounting plate 212 is intended to carry a speaker unit, it generally will require a 4-inch or international backbox to accept the rearwardly projecting parts of the speaker unit. The plate is shown, therefore, with only the two endmost openings 266, 274 along each side of the plate. As before, the openings 266, 274 are preferably oval-shaped and inclined to accommodate out-of-plumb backboxes.

In this embodiment, the transverse reinforcing ribs 288 and the ribs 288*a* surrounding the openings 266, 274, are formed entirely on the back side of the plate 212. The ribs 288 and the midpoint ribs 212*a* are preferably integrally formed with the flange 208 surrounding the aperture 206.

Although the invention has been described and illustrated herein by reference to a specific embodiment thereof, it will be understood that such embodiment is susceptible of modification and variation without departing from the inventive concepts disclosed. All such modifications and variations, therefore, are intended to be included within the spirit and scope of the appended claims.

I claim:

1. A mounting plate for mounting an audible-visual alarm to a backbox, comprising:

a plate having a front side and a back side;

a plurality of front-to-back openings in the plate located along at least one side of the plate for receiving at least one mounting fastener;

an enlarged front-to-back opening in the plate for facilitating electrical connection to alarm generating components;

at least one mounting element located at one side of the plate for engaging at least one cooperating mounting element on the alarm; and at least one opening formed in the plate at a location spaced from said one side of the plate for receiving a fastener for securing the alarm to the plate.

2. The mounting plate of claim 1, wherein said plurality of front-to-back openings in the plate are located along at least two sides of the plate.

3. The mounting plate of claim 2, wherein said plurality of front-to-back openings in the plate are located along each side of the plate.

4. The mounting plate of claim 2, wherein the number and spacing of said front-to-back openings along said at least two sides of the plate are substantially identical among said at least two sides of the plate.

5. The mounting plate of claim 1, wherein said plate is a generally square plate.

6. The mounting plate of claim 1, wherein said enlarged front-to-back opening is generally centrally located on said plate.

7. The mounting plate of claim 1, wherein said at least one mounting element located at one side of the plate comprises a plurality of said mounting elements on said one side of the plate for engaging a corresponding plurality of cooperating elements on the alarm.

8. The mounting plate of claim 1, wherein said at least one mounting element on the plate comprises a projecting member for engaging a complementary-shaped cooperating element on the alarm.

9. The mounting plate of claim 8, wherein said projecting member comprises a tab and said complementary-shaped cooperating element comprises a recess, wherein said tab is for inserting into said recess.

10. The mounting plate of claim 1, wherein said plate is a one-piece, injection-molded plastic member.

11. The mounting plate of claim 1, wherein said at least one opening comprises the only opening in said plate for receiving a fastener for securing the alarm to the mounting plate.

12. The mounting plate of claim 1, wherein said plurality of front-to-back openings are elongated in the plane of the plate for permitting adjustment of the plate relative to the mounting fasteners in the plane of the plate.

13. An audible-visual alarm and mounting plate assembly, comprising:

a plate having a front side and a back side;

a plurality of front-to-back openings in the plate located along at least one side of the plate for receiving at least one mounting fastener;

an enlarged front-to-back opening in the plate for facilitating electrical connection to alarm generating components;

at least one mounting element located at one side of the plate;

at least one opening formed in the plate at a location spaced from said one side of the plate for receiving a cover fastener; and an alarm cover for covering at least a portion of said front side of the plate, where said alarm cover has an opening for receiving said cover fastener and at least one cooperating mounting element for engaging said at least one mounting element located on said plate.

14. The assembly of claim 13, wherein said at least one mounting element and said at least one cooperating element are positioned relative to a feature of the alarm such that, when said cooperating mounting elements are engaged, the alarm cover is oriented with the plate where said feature of the alarm is positioned in a desired orientation.

15. The assembly of claim 14, wherein said alarm feature is a strobe lamp.

16. The assembly of claim 15, wherein said strobe lamp is carried by said alarm cover.

17. The assembly of claim 15, wherein said strobe lamp is carried by said plate.

18. The assembly of claim 13, wherein said at least one opening on said plate and said corresponding opening on said alarm cover comprise the only openings in said plate and said alarm cover, for receiving said cover fastener for securing said alarm cover to said mounting plate.

19. The assembly of claim 13, wherein said at least one mounting element on said one side of said plate comprises a plurality of said mounting elements, for engaging with a corresponding number of cooperating elements on said alarm cover.

20. The assembly of claim 13, wherein said plate is a one-piece, injection-molded plastic member.

21. The assembly of claim 13, wherein said plurality of front-to-back openings are sized and located for permitting said plate to be mounted to one of a plurality of different backboxes.

22. The assembly of claim 21, wherein said plurality of different backboxes include the single-gang backbox, the double-gang backbox, the four-inch backbox or the international backbox.

23. The assembly of claim 13, wherein said plurality of front-to-back openings comprise at least four openings along said at least one side of the plate, where two of said openings being located adjacent the respective ends of said at least one side of the plate and defining end openings, and where two of said openings with each being located between one of said end openings and a substantially midpoint of said at least one side of the plate, and defining intermediate openings.

24. The assembly of claim 23, wherein said plurality of front-to-back openings further comprises an additional opening being located at said substantially midpoint of said at least one side of the plate and defining a center opening.

25. The assembly of claim 24, wherein said end openings along said at least one side of the plate are sized and positioned for permitting the mounting of said plate to a four-inch backbox and to an international backbox, and wherein said center opening along said at least one side of the plate is sized and positioned for permitting the mounting of said plate to a single-gang backbox, and wherein said intermediate openings along said at least one side of the plate are sized and positioned for permitting the mounting of said plate to a double-gang backbox.

26. The assembly of claim 24, wherein said center opening comprises an oval-shaped opening that is substantially parallel to said at least one side of the plate.

27. The assembly of claim 23, wherein at least one of said end openings comprises at least in part an oval-shaped opening that is inclined at an angle to an adjacent side of said plate.

28. The assembly of claim 23, wherein at least one of said intermediate openings comprises at least in part an oval-shaped opening that is inclined at an angle to an adjacent side of said plate.

29. The assembly of claim 13, wherein said plurality of front-to-back openings are elongated in the plane of said plate for permitting adjustment of said plate relative to said at least one mounting fastener.

30. A mounting plate for mounting an audible-visual alarm to a backbox, comprising:

a plate having a front side and a back side;

a plurality of front-to-back openings in the plate located along at least one side of the plate for receiving at least one mounting fastener;

an enlarged front-to-back opening in the plate for facilitating electrical connection to alarm generating components, where said enlarged front-to-back opening is surrounded on the front side of the plate by an upstanding base for receiving a strobe lamp; and at least one mounting element located at one side of the plate for engaging at least one cooperating mounting element on an alarm cover.

31. The mounting plate of claim 30, wherein said plurality of front-back openings along said at least one side of the plate includes at least two end openings, one located adjacent each end of said at least one side of the plate.

32. The mounting plate of claim 31, wherein said plurality of openings along said at least one side of the plate, further includes two intermediate openings, with each intermediate opening being located intermediate to one of said end openings and a substantially centerline of said at least one side of the plate.

33. The mounting plate of claim 31, wherein said end openings along said at least one side of the plate are sized and positioned for permitting the mounting of the plate to a four-inch backbox or to an international backbox.

34. The mounting plate of claim 32, wherein said intermediate openings along said at least one side of the plate are sized and positioned for permitting the mounting of the plate to a double-gang backbox.

35. The mounting plate of claim 30, wherein said plate further comprises:

a means for mounting a speaker to the back side of said plate; and at least one opening in said plate generally positioned over said speaker for allowing sound transmission through said plate.

36. The mounting plate of claim 30, wherein said plurality of front-to-back openings in said at least one side of the plate are elongated in the plane of said plate for permitting adjustment of the plate relative to said at least one mounting fastener.

37. A mounting plate for mounting an audible-visual alarm to a backbox, comprising:

a plate having a front side and a back side;

a plurality of front-to-back openings in the plate located along at least one side of the plate for receiving at least one mounting fastener;

an enlarged front-to-back opening in the plate for facilitating electrical connection to the alarm generating components of the alarm; and indicium on said front side of the plate for indicating a correct orientation of the plate when attached to a backbox for providing a desired orientation of a feature of the alarm.

38. The mounting plate of claim 37, wherein said indicium indicates said correct orientation of the plate as to a horizontal orientation of a feature of the alarm or a vertical orientation of the feature of the alarm.

39. The mounting plate of claim 37, wherein said feature of the alarm is a strobe lamp.

40. The mounting plate of claim 39, wherein said indicium comprises at least one of an arrow and word indicating said correct orientation of the plate for providing a desired orientation of the strobe lamp.

41. The mounting plate of claim 39, further comprising:

at least one mounting element located on at least one side of said plate; and an alarm cover having at least one cooperating element for engaging said at least one mounting element of said plate, wherein said strobe lamp is carried by said alarm cover, such that when said alarm cover is attached to the plate, said strobe lamp is in accordance with said correct orientation indicated by said indicium.

42. The mounting plate of claim 41, wherein said at least one mounting element on the plate comprises a projecting tab and said at least one cooperating element on said alarm cover comprises a recess for receiving said projecting tab.

43. The mounting plate of claim 37, further comprising:

at least one opening formed in the plate at a location spaced from said at least one side of the plate for receiving a cover fastener for securing an alarm cover to the plate.

44. The mounting plate of claim 43, wherein said at least one opening comprises the only opening in said plate for receiving said cover fastener for securing said alarm cover to the plate.

45. The mounting plate of claim 37, wherein said plurality of front-to-back openings in the plate are located along at least two sides of the plate.

46. The mounting plate of claim 37, wherein said plurality of front-to-back openings comprise at least four openings along said at least one side of the plate, where two of said openings being located adjacent the respective ends of said at least one side of the plate and defining end openings, and where two of said openings with each being located between one of said end openings and a substantially midpoint of said at least one side of the plate, and defining intermediate openings.

47. The mounting plate of claim 46, wherein said plurality of front-to-back openings further comprises an additional opening being located at said substantially midpoint of said at least one side of the plate and defining a center opening.

48. The mounting plate of claim 46, wherein at least one of said end openings comprises at least in part an oval-shaped opening that is inclined at an angle to an adjacent side of said plate.

49. The mounting plate of claim 37, wherein said enlarged opening is surrounded on the front side of said plate by an upstanding base, where said feature of said alarm is mounted to said upstanding base.

* * * * *

UNITED STATES PATENT AND TRADEMARK OFFICE

CERTIFICATE OF CORRECTION

PATENT NO. : 6,271,763 B1
DATED : August 7, 2001
INVENTOR(S) : Hur

It is certified that error appears in the above-identified patent and that said Letters Patent is hereby corrected as shown below:

Column 1,
Line 36, please replace "backbones" with -- backboxes --.
Line 62, please delete "10".

Column 2,
Line 56, please replace "backbones" with -- backboxes --.

Column 4,
Line 44, please replace "take" with -- taken --.
Line 49, please replace "is" with -- of --.
Line 65, please delete " ' ".

Column 5,
Line 50, please delete "5".

Column 6,
Line 65, please replace "So" with -- 50 --.

Column 16,
Line 27, please replace "front-back" with -- front-to-back --.

Signed and Sealed this

Thirtieth Day of April, 2002

*Attest:*

*Attesting Officer*

JAMES E. ROGAN
*Director of the United States Patent and Trademark Office*